US007971542B2

(12) United States Patent
Block et al.

(10) Patent No.: US 7,971,542 B2
(45) Date of Patent: Jul. 5, 2011

(54) SYSTEM AND METHOD FOR PROCESSING MATERIAL PANELS

(75) Inventors: Paul Block, Nesconset, NY (US); Michael Lydick, East Bend, NC (US)

(73) Assignee: L & P Property Management Company, South Gate, CA (US)

( * ) Notice: Subject to any disclaimer, the term of this patent is extended or adjusted under 35 U.S.C. 154(b) by 1177 days.

(21) Appl. No.: 11/706,007

(22) Filed: Feb. 14, 2007

(65) Prior Publication Data

US 2007/0199493 A1 Aug. 30, 2007

Related U.S. Application Data

(60) Provisional application No. 60/777,306, filed on Feb. 28, 2006.

(51) Int. Cl.
*D05B 11/00* (2006.01)
*D05B 35/00* (2006.01)

(52) U.S. Cl. ..... 112/2.1; 112/306

(58) Field of Classification Search ..... 112/98, 112/2.1, 470.01–470.13, 305, 306, 271–277, 112/475.05; 700/136–138
See application file for complete search history.

(56) References Cited

U.S. PATENT DOCUMENTS

| | | | | | |
|---|---|---|---|---|---|
| 3,611,856 | A * | 10/1971 | Adair | 83/107 |
| 4,192,241 | A * | 3/1980 | Reed et al. | 112/117 |
| 4,248,656 | A * | 2/1981 | Hofmann | 156/358 |
| 4,958,579 | A * | 9/1990 | De Weers | 112/2.1 |
| 5,245,760 | A * | 9/1993 | Smart et al. | 33/735 |
| 5,540,160 | A * | 7/1996 | Rea | 112/217.2 |
| 5,697,309 | A * | 12/1997 | Ogle et al. | 112/2.1 |
| 6,050,166 | A * | 4/2000 | Gauler et al. | 83/209 |
| 6,293,213 | B1 * | 9/2001 | Block et al. | 112/470.05 |
| 2006/0034421 | A1 * | 2/2006 | Barkow et al. | 378/20 |

* cited by examiner

*Primary Examiner* — Ismael Izaguirre

(74) *Attorney, Agent, or Firm* — Shook Hardy & Bacon, LLP

(57) ABSTRACT

A system for processing a material panel is provided including a table supported by a plurality of legs, the table having at least one linear edge. A sewing machine is provided functionally connected to the table at the at least one linear edge. An elongate track is provided mounted along the at least one linear edge. At least one sensor movable along said track is provided for measuring at least a length of the material panel.

19 Claims, 17 Drawing Sheets

SYSTEM AND METHOD FOR PROCESSING MATERIAL PANELS

The present application claims priority from U.S. Provisional Application Ser. No. 60/777,306 entitled, "Automated Serger Flanger," filed on Feb. 28, 2006.

BACKGROUND

1. Technical Field

The present invention relates generally to sewing machinery, and more specifically, to an overlock sewing machine and flanger system especially for use in processing heavy duty fabrics, textile materials and the like, such as material or fabric panels for use in mattress construction.

2. Description of Related Art

When preparing and quilting panels for use as, e.g., top and bottom cover panels in mattresses, the panels are generally initially cut with spare material in both the length and width dimensions. This is due to the fact that the next operation after cutting the cover panel (which leaves raw edges on all four sides) is to sew and close the panel, e.g., with an overlock sewing machine.

While it is desirable to leave a consistent overcut (e.g., typically about 1.0 inch to about 3.0 inches of extra material overhanging each edge of the panel), quilting operators often set up panel cutters inconsistently, leaving more or less than the desired material overcut on the length and width dimensions of each panel. In addition to this problem, manual sewing operators often trim panels inconsistently, either trimming too much or not enough material. Further, the panels, once trimmed in their length and width dimensions, undergo some amount of shrinkage due to tension applied in the sewing pattern, thus affecting their actual overall length and width dimensions, often by an inch or more.

Moreover, when processing (trimming/sewing) the corners of a panel (preferably to achieve rounded corners), sewing operators often have great difficulty in producing consistent results in accordance with factory-specified corner radius specifications. For example, due to material handling issues and/or human inconsistency, operators of serger/flanger machines often will, e.g., begin the corner turn too early/too late, and/or not turn the panel smoothly and consistently during the pivot, resulting in a less than the optimal (e.g., 90 degree) arc. As such, a number of defective panels are inevitably produced and wasted.

Typically, in fully automated machinery, processes are performed by the machine to adhere to specific guidelines and are carried out in accordance with specific protocol at definite times. Consequently, the processes are often forced and a human operator has little or no control or input during, e.g., manipulation and sewing of a product. Machines that strictly dictate the procedures that must be done and how quickly the operator must perform the task, invoke a disconnected and forced work atmosphere, causing stress to human operators and ultimately reducing finish quality of the product. Bulky materials, such as, e.g., mattress panels, often require fine-tuning in their positioning and orientation during processes such as trimming and sewing. Such fine-tuning must also be performed in real-time and is difficult, if not impossible to achieve satisfactorily via machinery alone.

Accordingly, an efficient and effective system and method for accurately producing consistently sized and shaped mattress cover panels according to desired dimensions while incorporating user input in real-time is highly desirable.

SUMMARY OF THE INVENTION

A system and method is provided for automated measurement, adjustment and processing of material panels, e.g., mattress panels while incorporating human user input, thus enabling production of panels having dimensions (e.g., length/width) that consistently and accurately correspond to pre-programmed sets of desired dimensions while allowing a human operator to perform, e.g., real-time tactile adjustments as needed during the sewing/cutting process.

According to one aspect, a system for processing a material panel is provided comprising a table supported by a plurality of legs, the table having at least one linear edge and a sewing machine functionally connected to the table at said at least one linear edge. An elongate track is provided mounted along the at least one linear edge, and at least one sensor movable along said track is provided for measuring at least a length of the material panel.

According to another aspect, a system for processing a material panel is provided comprising a table supported by a plurality of legs, the table having at least one linear edge and a sewing machine functionally connected to the table at the at least one linear edge. An elongate track is provided mounted along the at least one linear edge and a plurality of sensors mounted at predetermined locations along the track are provided for providing measurement feedback of at least one edge of the material panel.

According to yet another aspect, a system for processing a material panel is provided comprising a table supported by a plurality of legs, the table having at least one linear edge and a sewing machine functionally connected to the table at said at least one linear edge. An elongate track is provided mounted along the at least one linear edge and an operator interface operably connected to at least the sewing machine is provided configured for inputting desired measurement data for the material panel.

According to yet another aspect, a method for processing a material panel is provided comprising the steps of processing at least one edge of the panel using a tension control process, wherein the step of processing further comprises the steps of gripping a first end of the panel using a first carriage, moving the first carriage using a second carriage, and deactivating the second carriage if a tension between the first and second carriages exceeds a predetermined force.

According to yet another aspect, a system for processing a material panel is provided comprising a table supported by a plurality of legs, the table having at least one linear edge, and an elongate track mounted above the table along the at least one linear edge. A pivot assembly is provided fixedly mounted at a first end of the track and a pivot arm is provided having a first end fixedly attached at the pivot assembly and configured for rotational movement about said first end. A gripper assembly is provided slidably mounted on the track, the gripper assembly further comprising an actuator carriage and a carriage fixture attached to said actuator carriage via a tension control system.

According to yet another aspect, a system for processing a mattress panel is provided comprising an elongate linear track, and a pivot assembly fixedly mounted at a first end of the track. A pivot arm is provided having a first end fixedly attached at the pivot assembly and configured for rotational movement about the first end. A gripper assembly is provided slidably mounted onto the track, the assembly further comprising an actuator carriage and a carriage fixture attached to the actuator carriage via a tension control system.

These, and other aspects, features and advantages of the present invention will be described or become apparent from the following detailed description of the preferred embodiments, which is to be read in connection with the accompanying drawings.

BRIEF DESCRIPTION OF THE DRAWINGS

In the drawings, wherein like reference numerals denote similar elements throughout the views.

DETAILED DESCRIPTION OF PREFERRED EMBODIMENTS

According to one aspect of the present invention, a system and method is provided for automated, real-time measurement, adjustment and processing of material panels, e.g., fabric panels such as mattress panels, while incorporating human user input, thus enabling production of panels having dimensions (e.g., length/width) that consistently and accurately correspond to pre-programmed sets of desired dimensions while allowing a human operator to perform, e.g., real-time tactile adjustments as needed during the measuring/sewing/cutting, etc. process. A system and method according to the present invention automatically stops and locks each panel at correct pre-pivot locations and turns each corner at precisely the desired amount (e.g., rectangular panels are preferably pivoted at a 90 degree arc to process each side/edge). However, while automatic control of the pivoting process is provided, a system according to an aspect of the present invention also accords the human operator a degree of control and influence over pivoting/sewing maneuvers and maintains the material in a tension-free, relaxed state at all times during processing. An automated measuring, adjusting and pivoting process which simultaneously takes into account real-time human input according to one aspect of the present principles advantageously minimizes handler/operator error and prevents waste due to, e.g., defective panels while preserving the operator's ability to make tactile adjustments to the material comfortably in real-time.

Note that placement and orientation of the elements as shown in the Figures is for exemplary and illustrative purposes only, and alternate locations of any of the elements may be contemplated. Further, a system and method according to the present principles may be applied to any type of material panels, not necessarily mattress panels.

Figure 1:
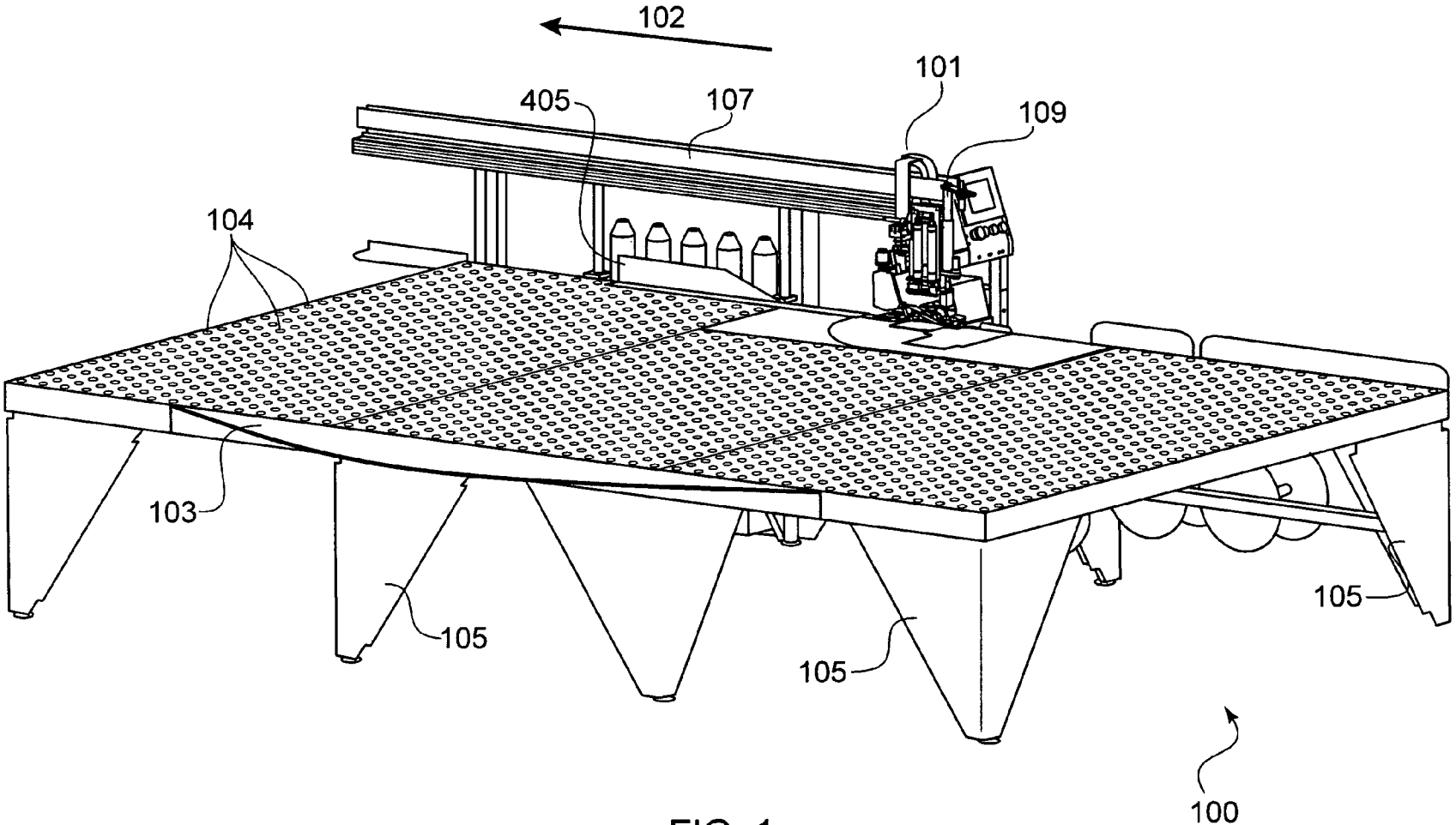
FIG. 1 is a front perspective view of a serger flanger system showing a gripper assembly in a forward position according to an aspect of the present invention.
Figure 2:
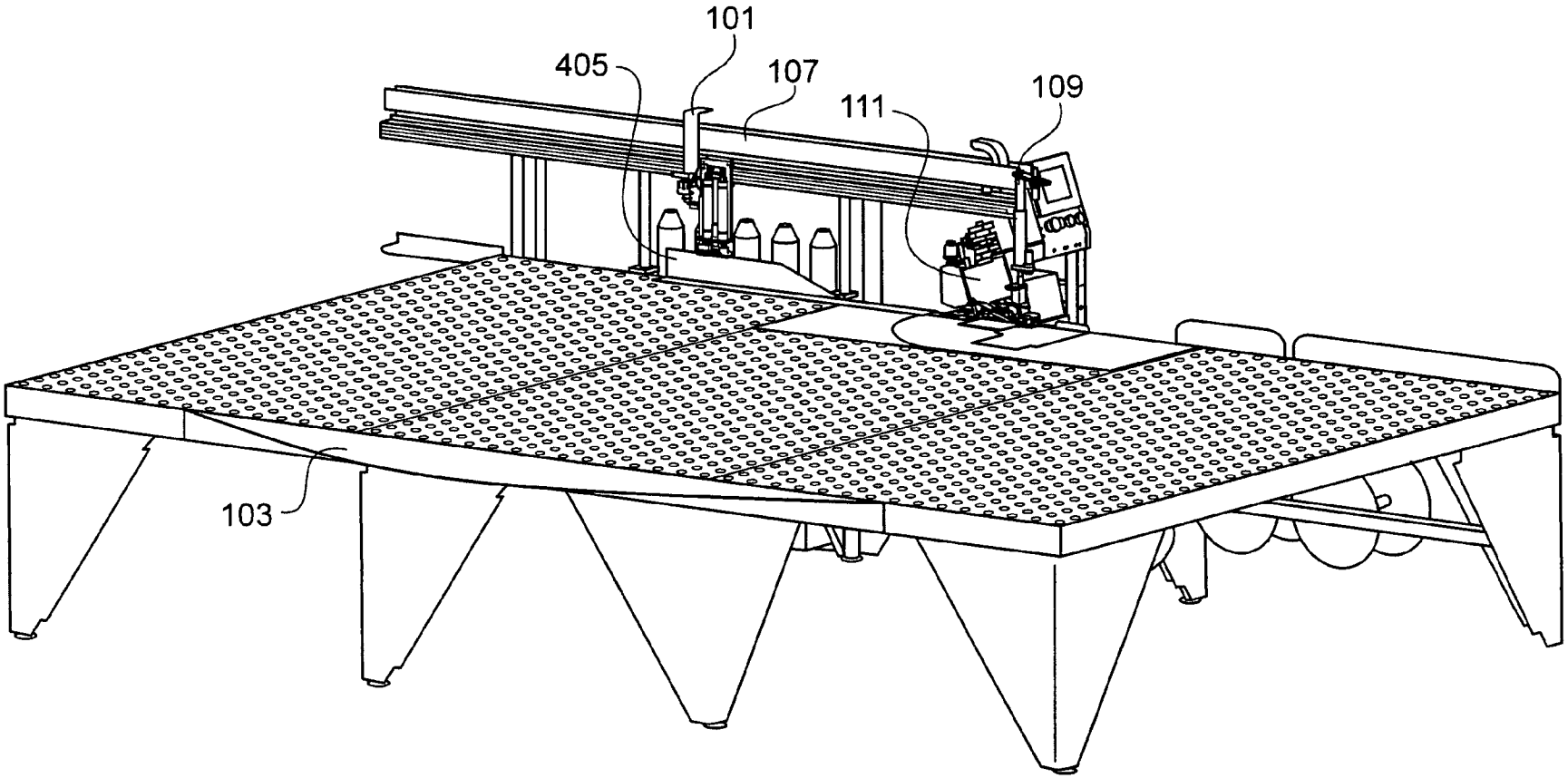
FIG. 2 is front perspective view of a serger flanger system showing a gripper assembly in a midway position according to another aspect of the present invention.
Figure 3:
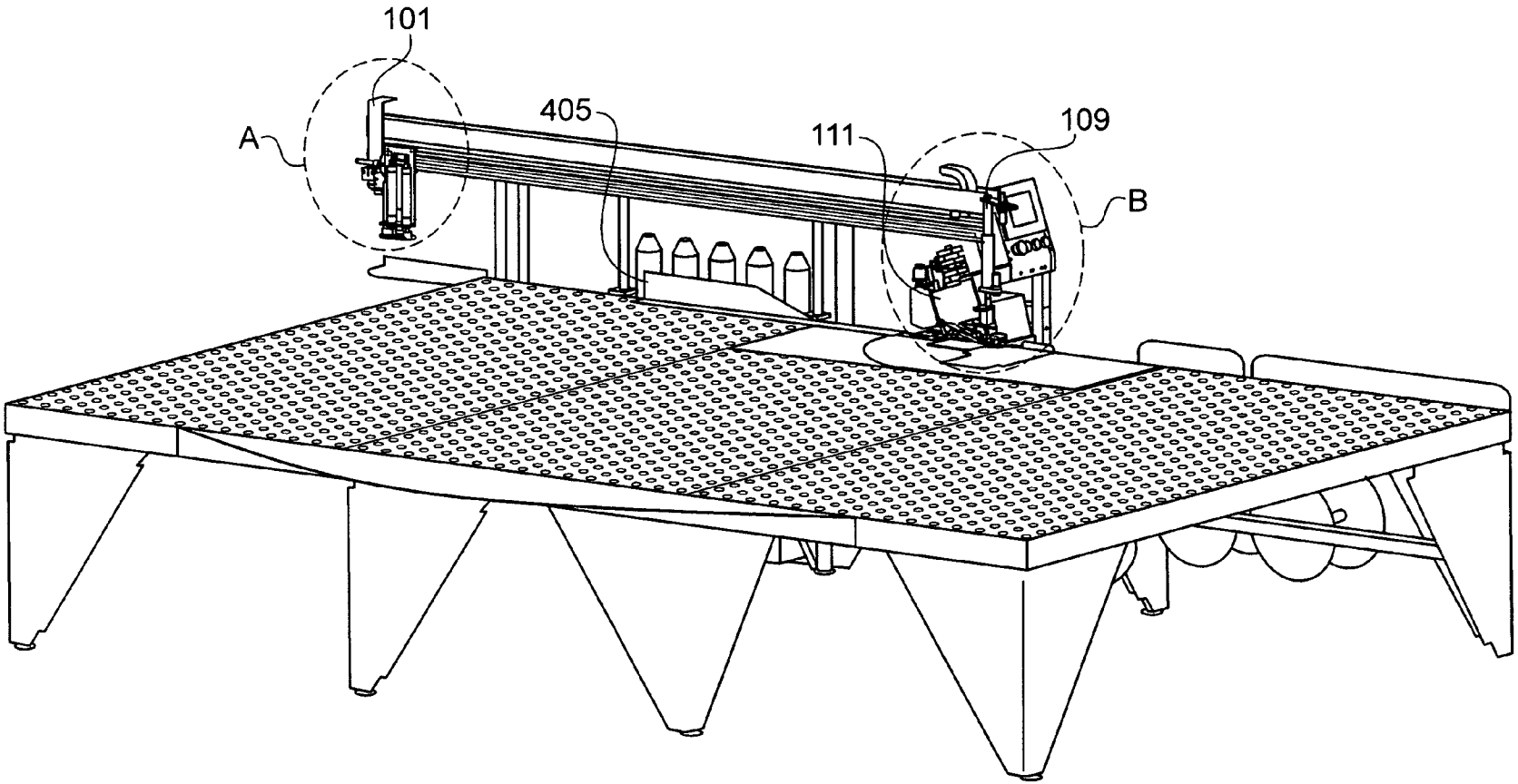
FIG. 3 is front perspective view of a serger flanger system showing a gripper assembly in a rear position according to another aspect of the present invention.

Referring now to the Figures, FIGS. 1-3 depict front perspective views of a serger flanger system 100 showing a gripper assembly 101 in forward, midway and rear positions, respectively, according to aspects of the present invention. The system 100 is comprised of a table 103 supported by a plurality of legs 105, each of which is preferably independently adjustable at least in height, so as to enable positioning of the table 103 at various heights and/or dispose the table at various angles or inclines. The table may be configured for manual or automatic height adjustment (e.g., via a pneumatic system). For example, legs 105 may be adjusted to be higher on one side of the table 103 than the other, thus causing table 103 to be sloped at an angle. This permits a material panel 1101 (e.g., see FIGS. 11-13) loaded onto the table to itself be tilted during processing and due to gravity, have one edge rest more heavily on a guide plate (e.g., an edge guide 901, described further below with reference to FIGS. 9-13) in front of the sewing machine during sewing. For example, preferred operational settings may comprise wherein the table 103 is provided at angles ranging from, e.g., about 5 degrees to about 15 degrees, and most preferably, comprises about 10 degrees. Such angulation of the table surface advantageously facilitates 'processing' (e.g., procedures such as measuring, sewing, cutting, etc.) of the material panels during operation.

The height of table 103 in relation to the ground may also be adjusted to custom fit a human operator, thus decreasing strain during operation and improving ergonomics. The table 103 may comprise, e.g., an 'air' table, including a plurality of openings 104 at least on a top surface thereon through which air is caused to be emitted, therefore reducing friction on materials placed on a top surface.

The gripper assembly 101 is positioned above the table 103 by way of an elongate linear actuator or track 107 which is mounted longitudinally along one side of the table 103. The gripper assembly 101 is slidably mounted onto the actuator 107, and configured to be freely slidable along the length of the track 107. For example, in a fully forward position, the gripper assembly 101 is positioned closest to a pivot assembly 109, with midway and rear positions having the gripper assembly 101 positioned further away from the pivot assembly 109. The pivot assembly 109 is preferably fixed to one end of the linear track 107 adjacent to a sewing machine 111 and is the location at which a human operator is typically positioned during processing of a panel and operation of the system 100.

Figure 4:
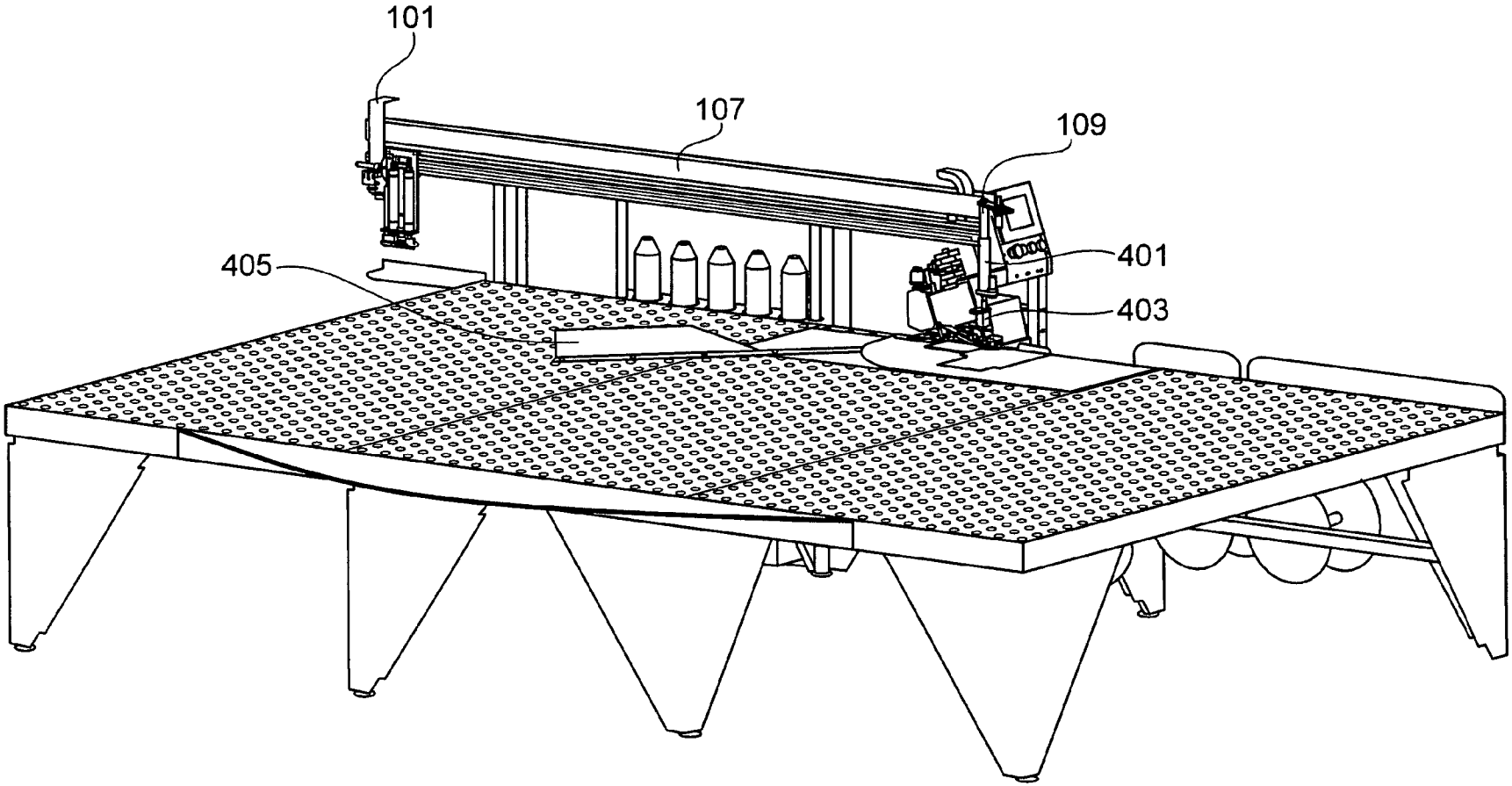
FIG. 4 is front perspective view of a serger flanger system depicting a pivot arm in a partially deployed position according to another aspect of the present invention.
Figure 5:
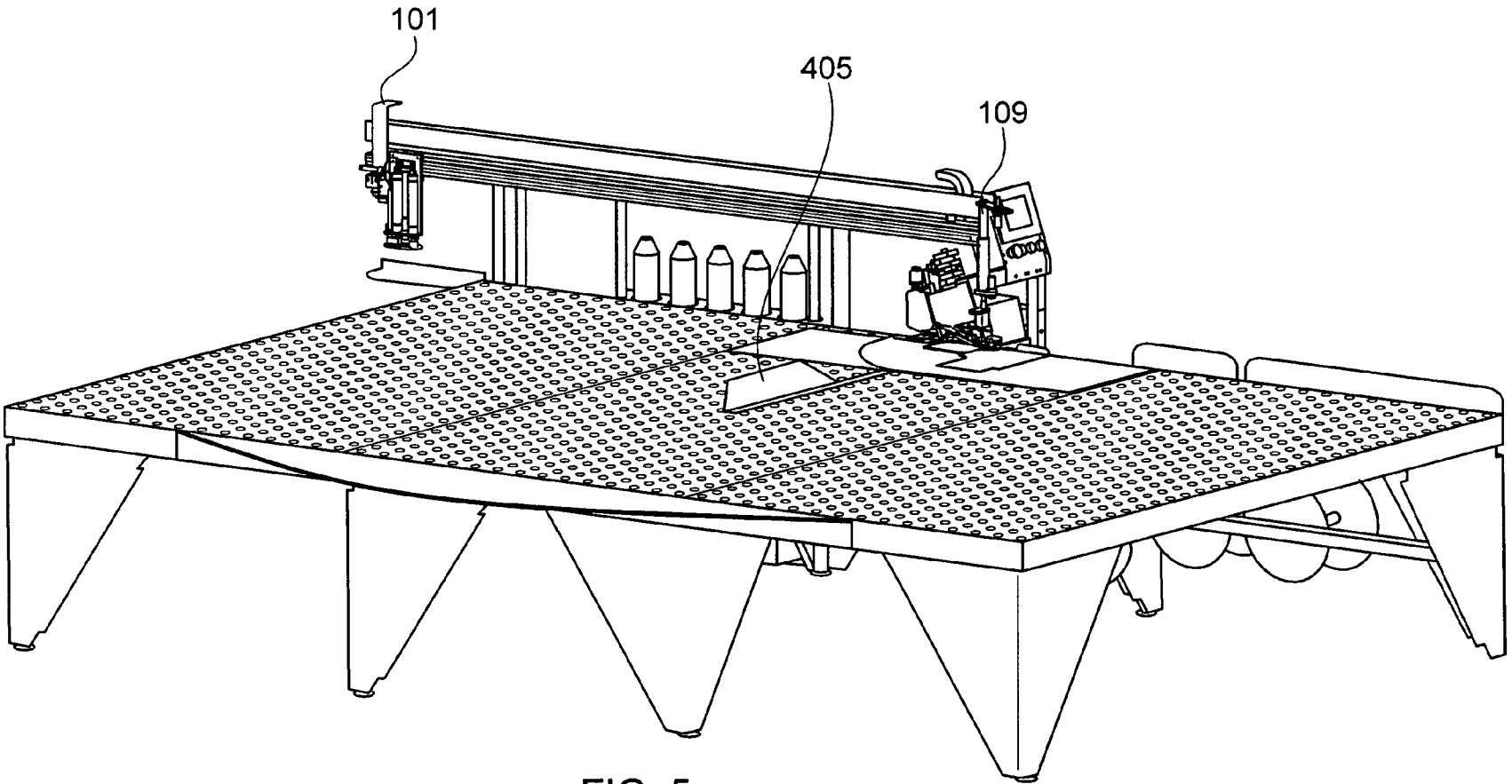
FIG. 5 is front perspective view of a serger flanger system depicting a pivot arm in a fully deployed position according to another aspect of the present invention.

FIGS. 4 and 5 are front perspective views of a serger flanger system depicting a pivot arm 405 in a partially deployed position (e.g., about 45 degrees) and a fully deployed position (e.g., about 90 degrees), respectively, according to aspects of the present invention. The pivot arm 405 is comprised of an elongate plate generally 'connected' to, e.g., at least a base of the pivot assembly 109 at one end and configured for rotational movement about said connected end. The pivot arm 405 may be 'connected' to the pivot assembly 109, e.g., in the sense that they may share, e.g., a common base plate, however, not necessarily a common centerpoint. That is, the pivot arm 405 may be 'connected' to the pivot assembly 109 yet does not have to move a mattress panel in an arc precisely corresponding to a center of the pivot assembly 109. In the case of a rectangular panel, the pivot arm 405 is typically configured to move in, e.g., a substantially 90 degree arc. Note however, that the range of movement of the pivot arm 405 may be adjustable as desired so as to comprise less than or greater than 90 degrees.

Figure 11:
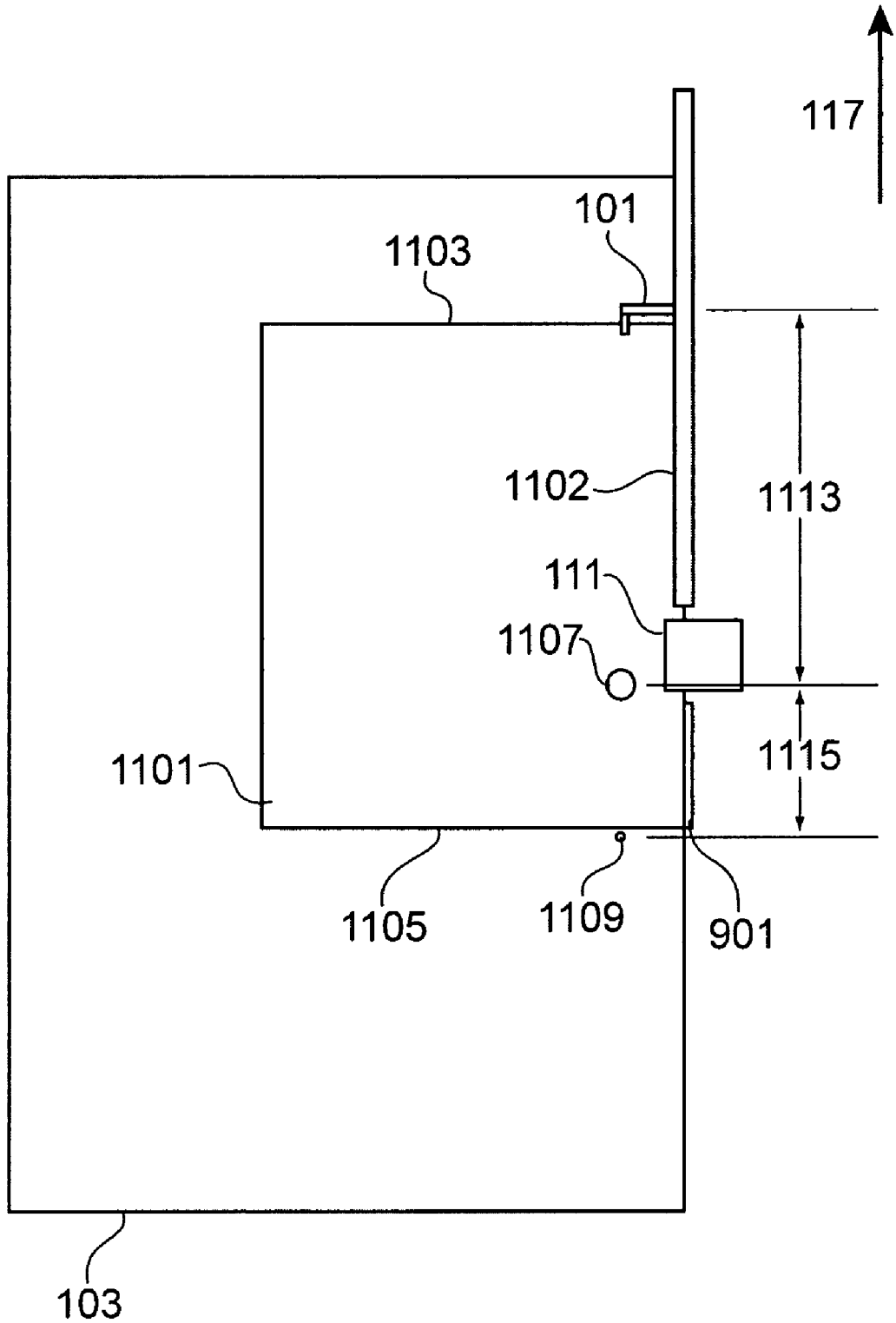
FIG. 11 is a top schematic view of a serger flanger system including a loaded panel 1101 according to an aspect of the present invention.

When a panel 1101 (e.g., mattress panel) is properly positioned on the table 103 for processing (measuring, sewing, cutting, etc.), one side/edge of the panel is placed adjacent to the pivot arm 405 (e.g., as shown in FIG. 11). During processing, when the panel is ready to be turned, the pivot arm 405 is deployed to turn the panel (e.g., about 90 degrees), thus providing a mechanical assist in handling the weight of the panel during pivoting, such that the operator does not have to pull the full weight of the material around the turn as the panel's corner edge is processed/sewn. Advantageously, this allows the operator to concentrate fully on tailoring the finish of the panel corner edge, and relieves the operator from the stress of moving the material entirely by hand at every turn. Further, the panel material is prevented from being unduly stretched, distorted or damaged by manual handling, tugging and pulling.

Figure 6:
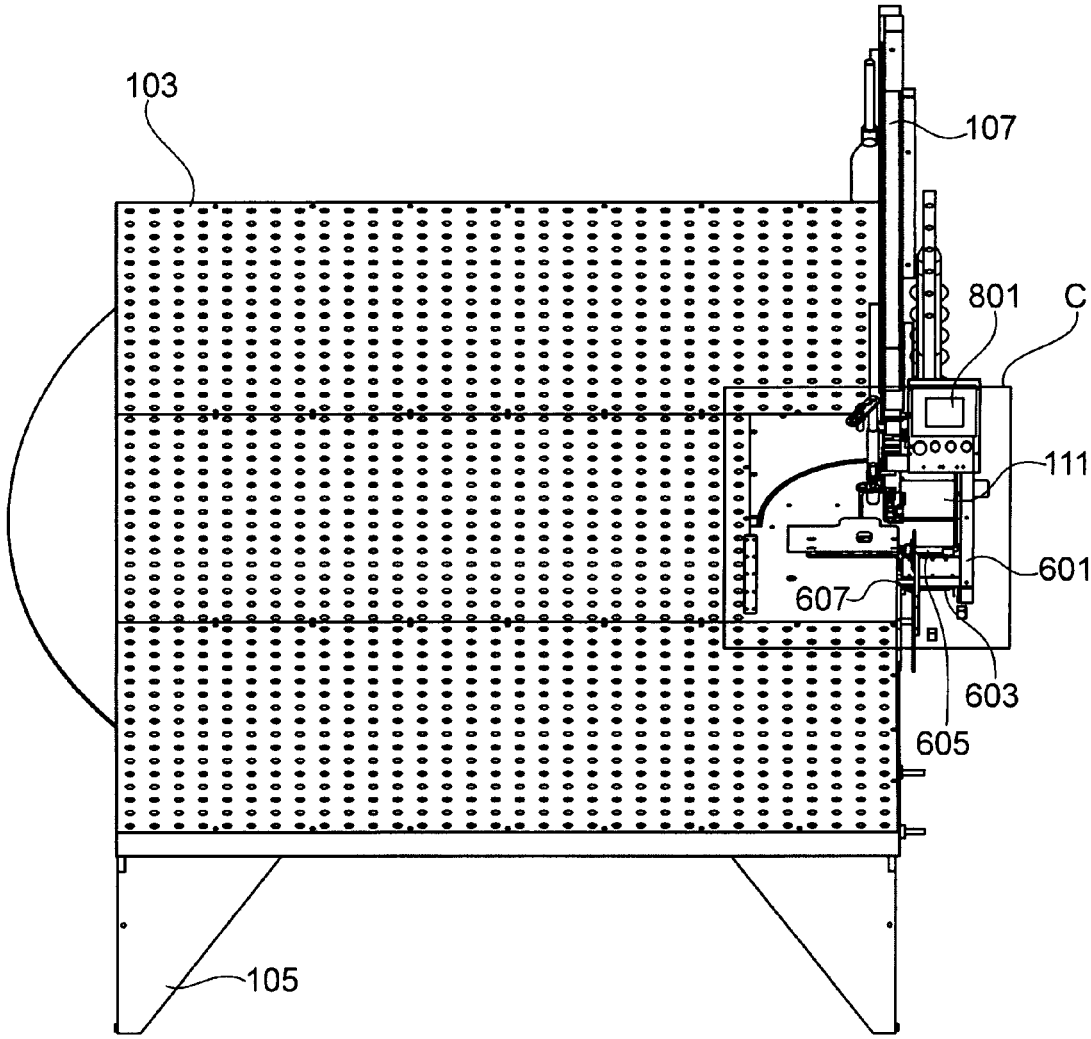
FIG. 6 is a right side perspective view of the serger flanger system of FIG. 3 according to another aspect of the present invention.

FIG. 6 is a right side perspective view of a serger flanger system according to an aspect of the present invention. The pivot assembly shown in area "B" includes a sewing machine 111 and a support 601 for an operator interface 801 (see FIG. 8). An adjustable edge guide 607 is provided slidably attached to guide shaft 603. The edge guide 607 may be adjustable and caused to be positioned at various increments along guide shaft 603 up to a maximum extension as determined by, e.g., industry standards (e.g., about 4 inches), so as to effectuate the desired amount of material length to be cut on each panel side (described further below with reference to FIGS. 9-10). Note that this amount may be changed as desired in accordance with, e.g., user input. Ball screw 605 is functionally connected to a motor (not shown) which receives data from a computer program in the interface 801 and drives the edge guide 607 along the guide shaft 603 via, e.g., rotational translation to generate accurate linear movements of the guide 607.

Figure 7:
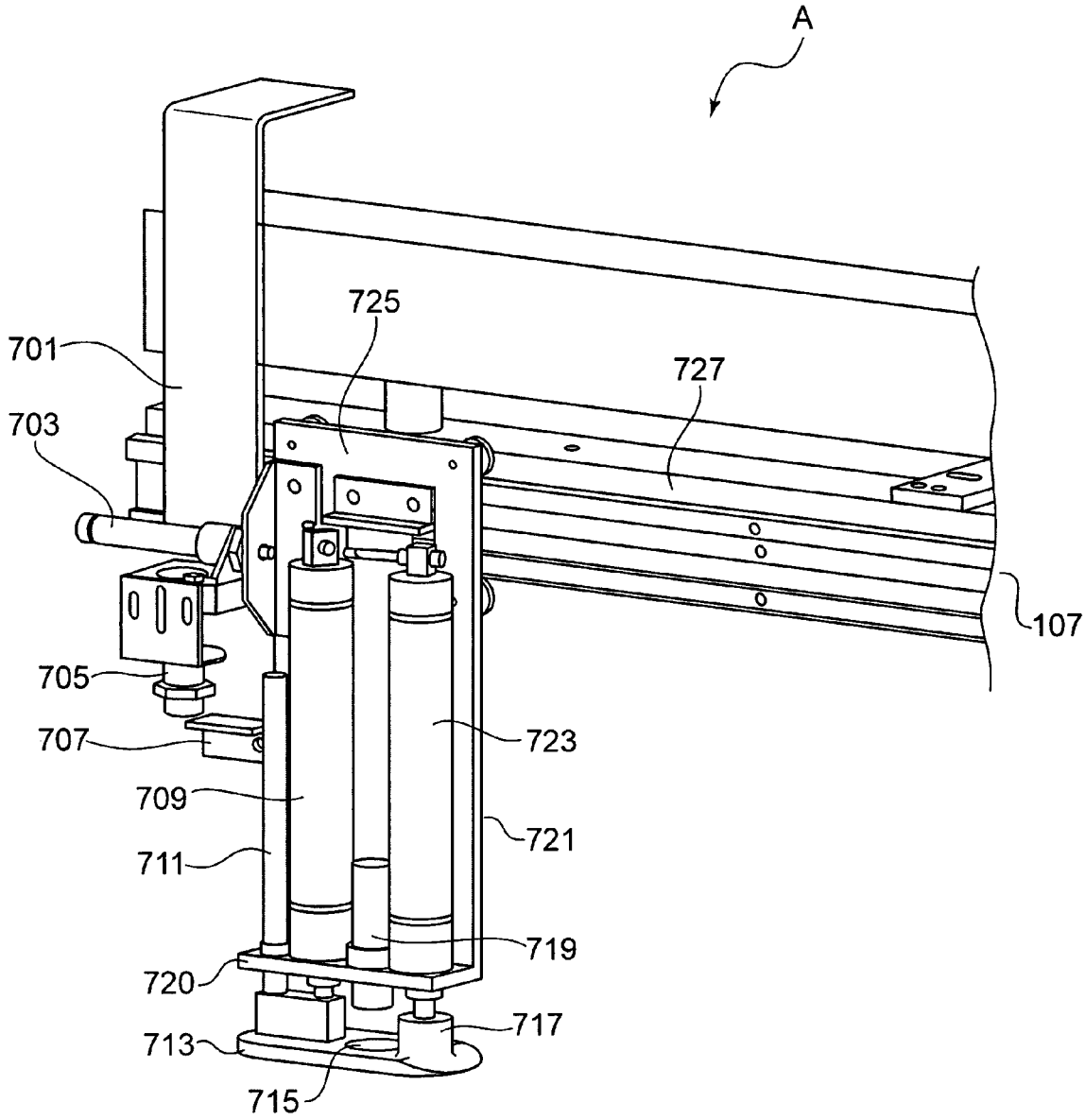
FIG. 7 is an enlarged front perspective view of a gripper assembly as shown in area "A" of FIG. 3 according to one embodiment of the present invention.

FIG. 7 is an enlarged front perspective view of the gripper assembly as shown in area "A" of FIG. 3 according to one embodiment of the present invention. According to one embodiment, a gripper assembly 101 comprises an actuator carriage 701 which is preferably motorized and includes a tension control system comprised of an air spring device 703, tension control sensor 705 and a sensor activator 707. The actuator carriage 701 with the tension control system is operably connected to a carriage plate or fixture 721 and configured to drive the fixture 721 along the track 107 in a controlled fashion with minimal tension or stress being exerted on the material (e.g., mattress panel) being held by the carriage plate 721.

The carriage plate 721 is slidably attached to the track 107 (e.g., via carriage wheels 729) and further includes clamp actuator cylinders 709, 723, a guide shaft 711 and a clamp plate 713 and clamp pad 717 operably mounted thereon. In one embodiment, the track 107 may include a sensor strip 727, configured to work together with at least one sensor 725 (e.g., mounted behind carriage plate 721) to assist in conveying distance information (and hence measuring panel edge lengths) as the carriage plate moves along the track 107, e.g., described further below with reference to FIGS. 11-13. In one embodiment, sensor 725 may comprise, e.g., at least one magnetic sensor and strip 727 may comprise a magnetic sensor strip. However, alternate sensor means/systems for assessing distance/measurement information of material panels may be contemplated, e.g., using at least one movable sensor (e.g., configured to be movable along track 107) and/or a plurality of discrete sensors located at predetermined positions along track 107. Sensor systems comprising e.g., linear and/or rotary encoders, ultrasonic sensor systems, multiple fixed reflective sensors arranged at predetermined locations along the track 107, etc. may be contemplated.

A material edge sensor 719 (e.g., a photocell/photoeye sensor) is provided mounted on an upper plate 720, and a corresponding sensor reflector 715 is provided on the clamp plate 713, both configured to detect an edge of the panel. During operation according to one embodiment, when an edge of material is detected via the material sensor 719 and reflector 715, the actuator carriage 701 is caused to stop moving and the clamp actuator cylinders 709, 723 are deployed, lowering the clamp pad 717 until it has successfully clamped the material onto the lower clamp plate 713. Advantageously, a gripper assembly incorporating a photocell edge detection system according to the present invention ensures that an leading edge of the panel is fully and definitely captured for each run, despite any errors that might have previously occurred (e.g., operator error during turning). That is, the clamp pad 717 is configured to close down only when the sensor 719 has been activated.

Once the clamp pad and plate 717, 713 have engaged the material, the actuator carriage 701 is energized, such that the carriage 701 is caused to be moved in a backwards direction (e.g., depicted by arrow 102 in FIG. 1) away from the sewing machine 111. The carriage 701 continues to move until the tension between it and the carriage plate 721 exceeds a force of the air spring 703. When this force is exceeded, the actuator carriage 701 begins to separate from the carriage plate 721 until the tension control sensor 705 is activated by the sensor activator 707. That is, according to one embodiment, the sensor 705 may be activated while the activator 707 is located underneath it. When the actuator carriage 701 and the carriage plate 721 become separated (e.g., indicating that the carriage plate 721 is moving at a slower rate than the actuator carriage 701) the activator 707 will no longer be located beneath the sensor 705. This results in a loss of signal which accordingly causes the actuator carriage 701 to be turned off and the carriage plate 721 to be stopped. Advantageously, a tension control process according to an aspect of the present invention ensures that the material to be processed is not caused to be subject to undesirable tension. "Undesirable tension" is defined as tension which elongates and/or stretches the fabric/material being processed. Stretching the material would distort the panel dimensions, and significantly and negatively affect the tolerance of the cut width of the trim material and accordingly lead to misshapen or otherwise defective panels with inaccurate dimensions.

Figure 8:
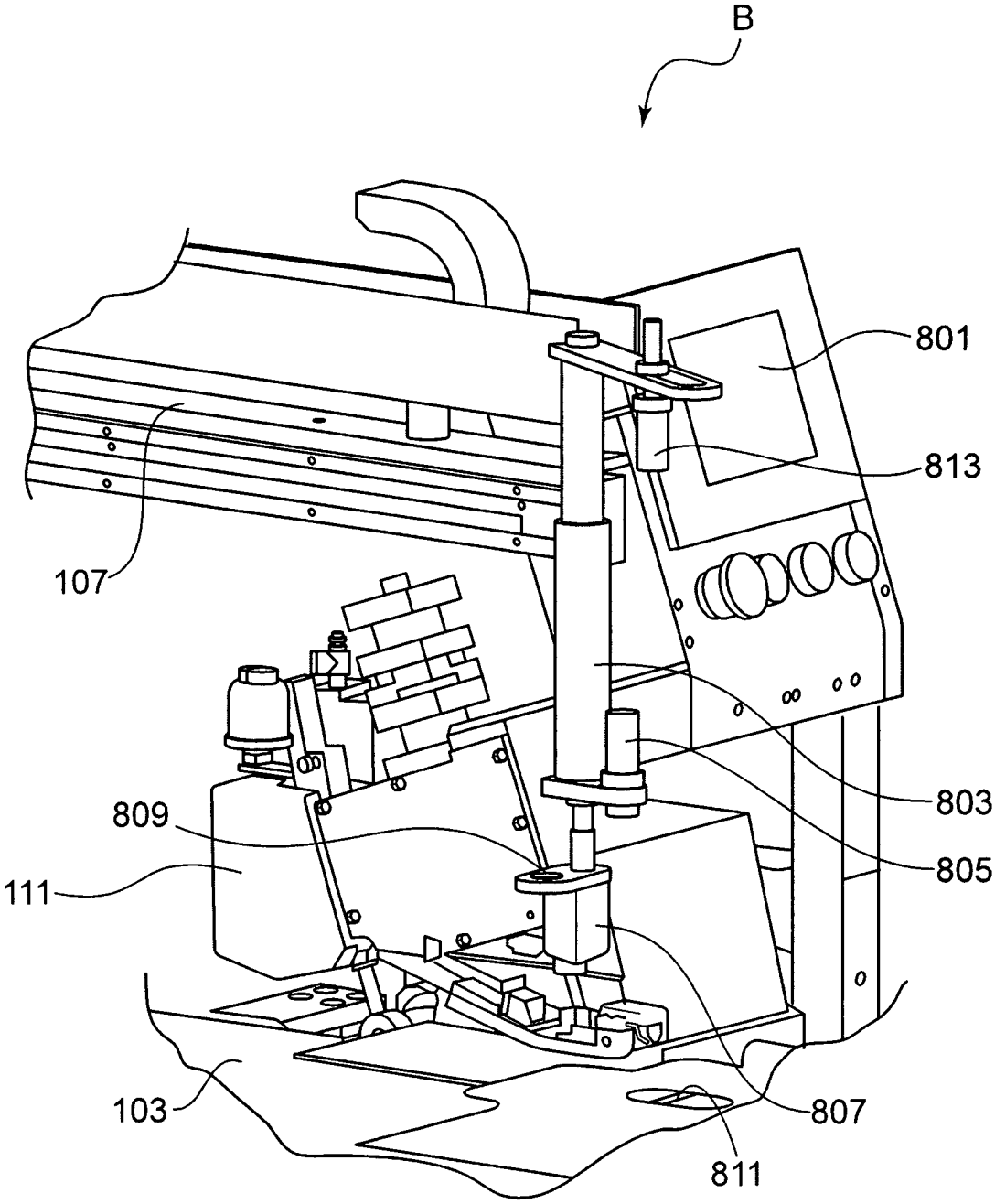
FIG. 8 is an enlarged front perspective view of a pivot assembly as shown in area "B" of FIG. 3 according to an aspect of the present invention.

FIG. 8 is an enlarged front perspective view of a pivot assembly 109 as shown in area "B" of FIG. 3 according to an aspect of the present invention. The pivot assembly 109 includes a pivot actuator 803 operably connected to activate a pivot clamp 807, and a pivot sensor 805 and a pivot sensor reflector 809 for triggering deployment and operation of the pivot actuator 803. For example, the pivot sensor 805 may be oriented at a first location and the pivot sensor reflector 809 at a second location, and deployment of the sensor 805 may be caused by movement of the reflector 809 from the second location to the first location.

A control interface 801 preferably including a screen display is provided operably connected to the serger system 100 (e.g., at least the sewing machine 111, the pivot assembly 109, the gripper assembly 101 and pivot arm 405) and configured to enable user input of settings, dimensions, measurements, etc. for material/mattress panel processing. For example, the operator interface 801 may be configured for a user to input at least desired lengths and widths for finished material panels. The interface 801 may comprise a computer having stored thereon software including algorithms for, e.g., measuring, cutting, sewing processes, etc.

Advantageously, a pivot system according to the present invention comprises a 'passive' pivot de-coupled from any drive source, thus enabling the operator to turn and manipulate a panel corner at his/her own speed. When the pivot assembly engages the panel corner, it is driven rotationally by the material itself as it is turned by the force imposed by the pivot arm 405. The pivot assembly provides a guide for the overall geometry of the movement, but the operator is allowed freedom to determine, e.g., how fast or slow the operation is to be performed, and can make real-time adjustments during corner processing (e.g., smooth out the fabric during sewing, pick up an edge and pull it tight during the turn, etc.).

Furthermore, the pivot actuator 803 is configured to be adjustable relative to the other components of the pivot assembly. That is, the pivot cylinder actuator 803 is configured to be movable, e.g., towards and away from the sewing machine 111 to, e.g., increase/decrease the pivot radius of the panel corners, thus enabling the creation of panels having varied radius sizes. Such adjustability may be provided via, e.g., use of fastening members to secure the pivot actuator which may be loosened or tightened as desired, and/or an automatic adjustment system including an additional actuator connected to the pivot actuator 803 which may be controlled through the operator interface 801.

The pivot sensor reflector 809 is operably connected to the pivot clamp 807, such that rotation of the pivot clamp 807 during turning of a material panel 1101 causes the pivot sensor reflector 809 to turn with it in a corresponding arc. That is, in operation, as the operator sews along one edge of a panel, the carriages 701, 721 move backwards in direction 102 with the material's leading edge grasped in clamp 717 until the trailing edge of the panel reaches a pivot actuation reflector 811, which works in conjunction with (e.g., is in functional communication with) a pivot actuation sensor 813. That is, e.g., the sensor 813 may be configured to transmit a polarized light beam to reflector 811, which may then be reflected back to the sensor 813. In the event a state of the light path is altered (e.g., the light path is reflected or interrupted due to, e.g., a panel edge) the sensor 813 may transmit a signal to the operator interface 801. The carriage 701 is stopped and once the panel 1101 stops moving, the clamp actuator cylinder 709, 723 disengages and lifts upwards, releasing the material 1101. Once the material is free of its grasp, the linear actuator 107 is energized again, moving the actuator carriage 701 and carriage plate 721 back to their rear-most position farthest from the sewing machine (e.g., as shown in FIG. 3) in a 'waiting' position, free and clear of the material.

At this point, the pivot actuator cylinder 803 is energized, driving the pivot clamp 807 onto the top of the material below. Preferably, the position of the pivot clamp 807 is preset to a desired amount (e.g., 2.0", 2.5", 3.0", etc.) at which the radius of the corner is to be configured. As a panel is rotated, each corner is accordingly trimmed and sewed by the sewing machine 111. Rotation of the panel is facilitated by the pivot arm 405 as discussed above, and as the pivot clamp 807 turns with the material, the pivot sensor reflector 809 turns with it, moving in a radial direction towards the pivot sensor 805.

When the reflector 809 is directly beneath the pivot sensor 805, this indicates that the panel has been rotated the precise desired amount (e.g., about 90 degrees for a rectangular panel, although this angular dimension may be adjusted as discussed above). For example, the pivot sensor 805 may be configured to direct polarized light in a downwards direction that can only be reflected by the reflector 809. The arrangement and use of the pivot sensor/reflector system according to an aspect of the present invention ensures consistent rotation of the panel and accordingly, consistent processing (cutting and sewing) of the panel corners.

Once the panel has been rotated the desired amount (e.g., when the pivot sensor reflector 809 has reached the pivot sensor 805), the pivot actuator cylinder 803 is de-energized and the pivot clamp 807 is retracted upwards, freeing the material. The pivot arm 405 is caused to swing back to its original, retracted 'home' position (e.g., as shown in FIGS. 1-3).

Figure 9:
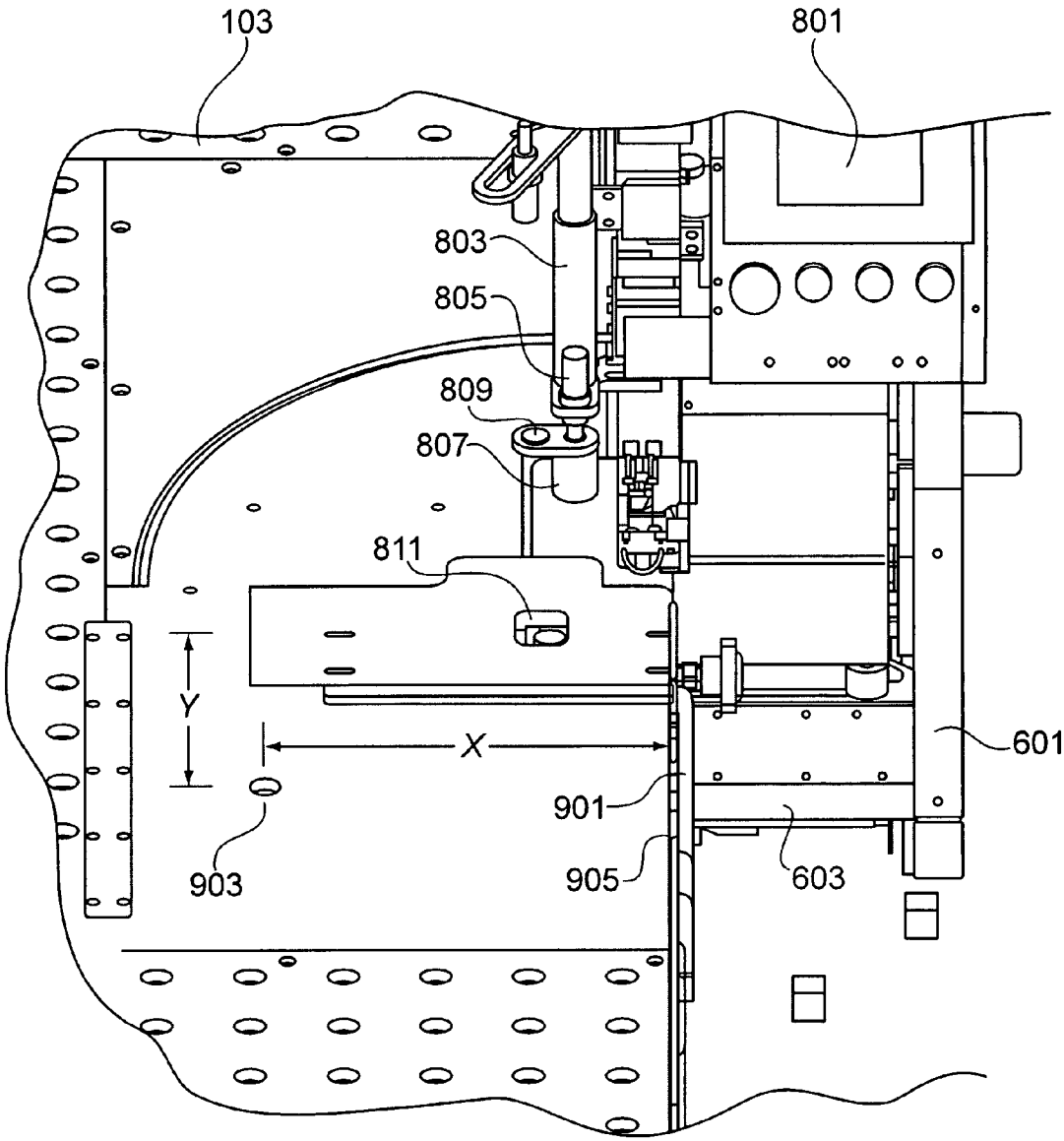
FIG. 9 is enlarged view of section "C" of FIG. 6 depicting a retracted edge guide according to an aspect of the present invention.
Figure 10:
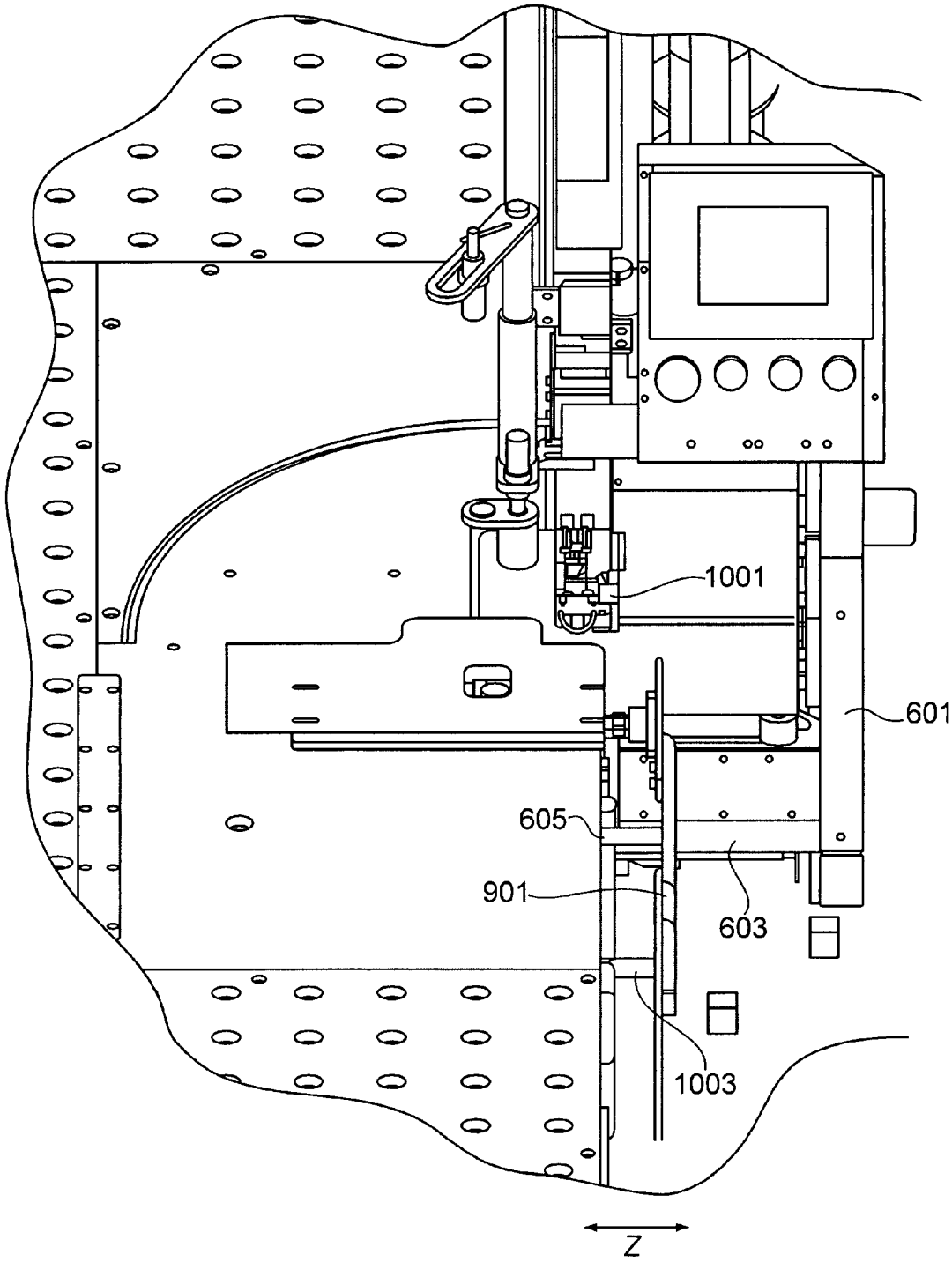
FIG. 10 is enlarged view of section "C" of FIG. 6 depicting an extended edge guide according to an aspect of the present invention.
Figure 12:
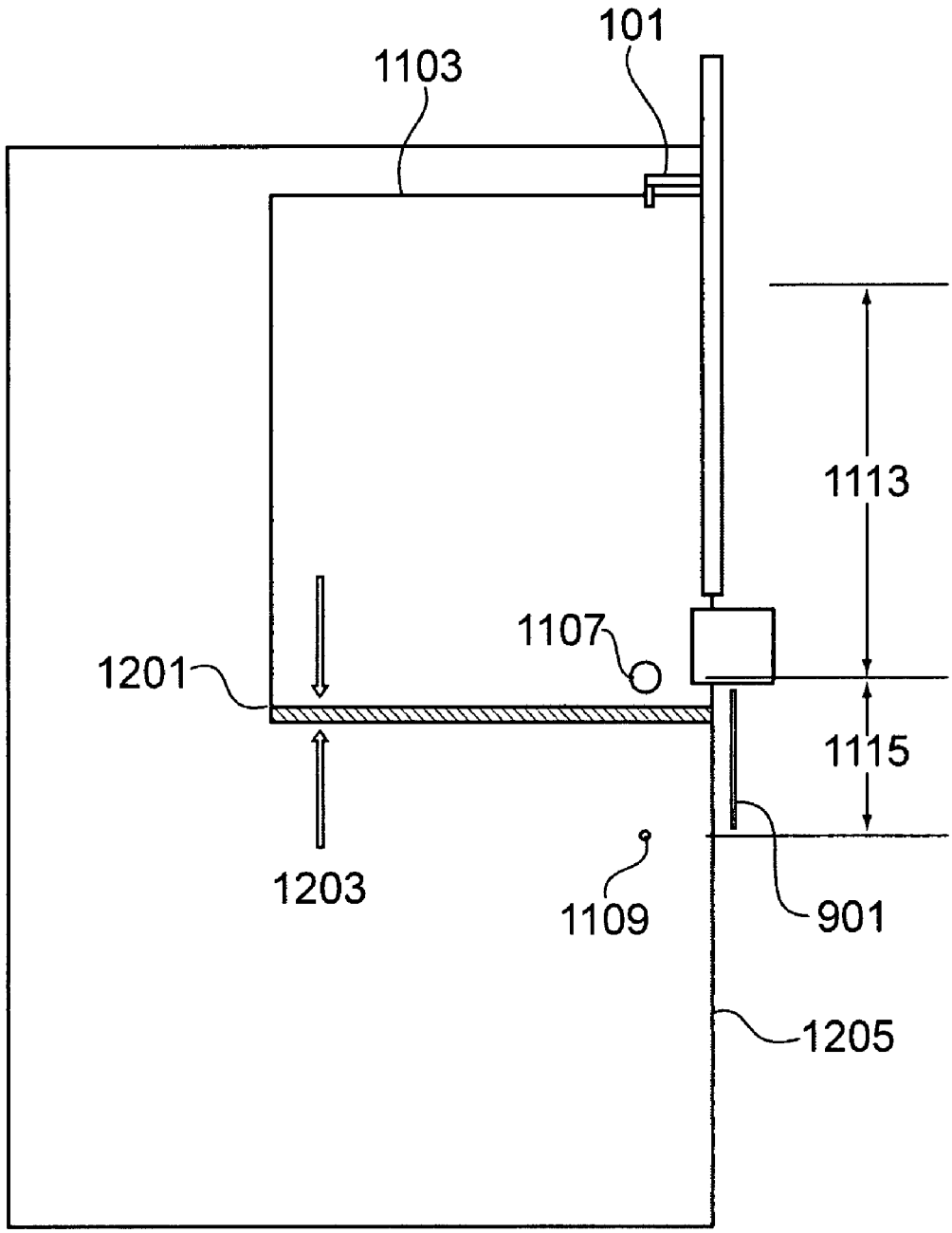
FIG. 12 is a top schematic view of a serger flanger system with the panel 1101 positioned for commencement of a pivot cycle according to an aspect of the present invention.
Figure 13:
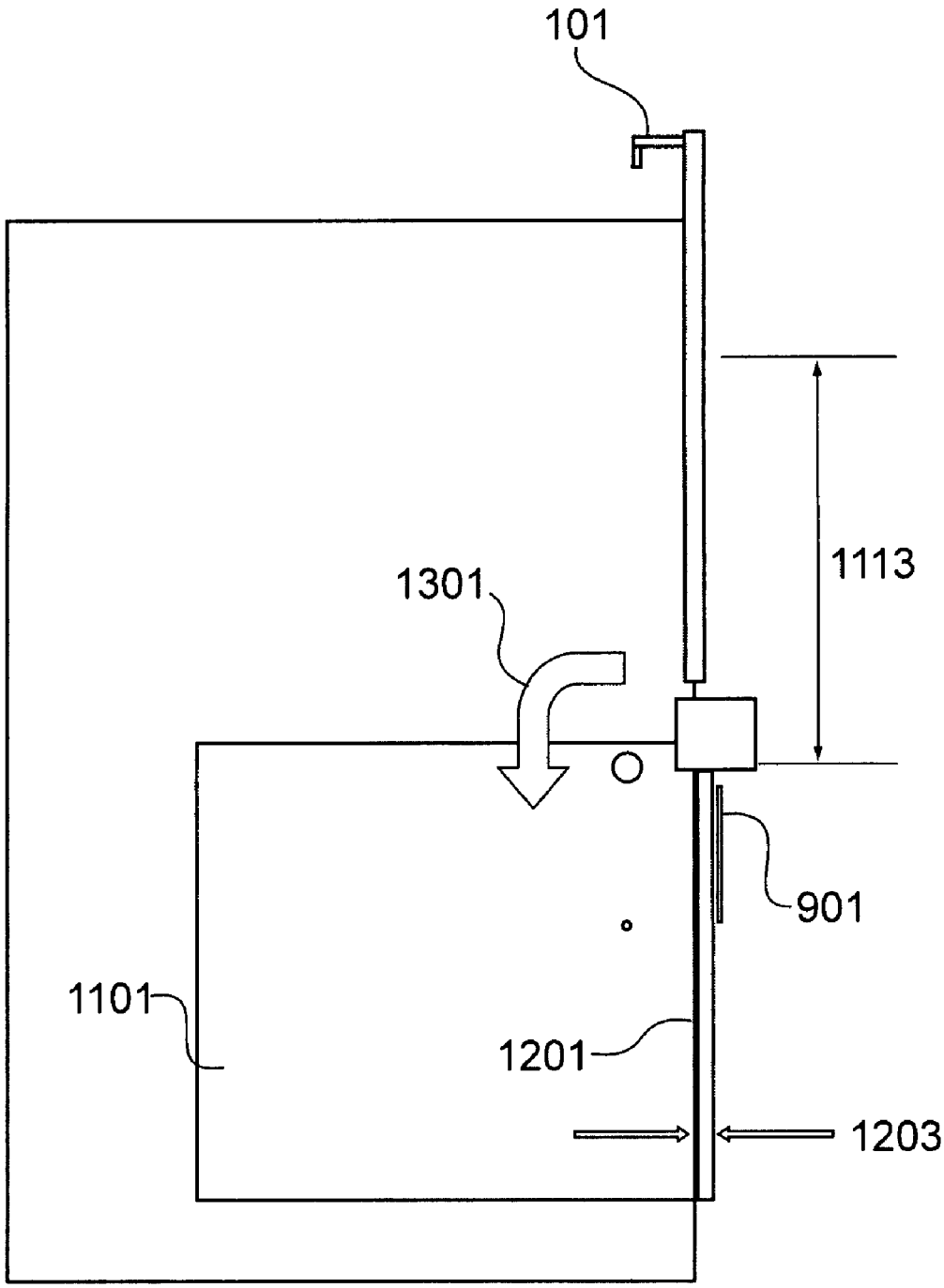
FIG. 13 a top schematic view of a serger flanger system including panel 1101 upon completion of the pivot cycle according to an aspect of the present invention.

FIGS. 9 and 10 are enlarged views of section "C" of FIG. 6 depicting retracted and extended edge guides, respectively, according to aspects of the present invention, and are heretofore described in conjunction with FIGS. 11-13, which schematically depict a panel 1101 at various phases of processing by a system according to the present invention.

FIG. 9 shows edge guide 901 retracted in a 'home' position, e.g., flush to table edge 905. The edge guide 901 is configured to be adjacent to a panel edge 1102 when in the home position. The edge guide 901 may be set in this position when e.g., a nominal edge trim of a panel is desired (e.g., up to about ½"). FIG. 10 shows edge guide 901 in an extended position, extended from table edge 905 along guide shaft 603 via ballscrew 605 a predetermined distance from table edge 905 in order to effectuate a desired trim amount of a panel edge. The edge guide 901 may be extended/retracted any desired distance in a direction Z from the table edge 905, e.g., preferably to a maximum extension of about 4 inches, and is operably connected to the user interface 801. Direction Z lies in a plane which is preferably substantially parallel to a plane of a surface of table 103. Edge guide 901 may be automatically adjustable in accordance with desired panel edge trim amounts which may be input to the interface 801 by an operator.

In an alternate embodiment, the edge guide 901 may be provided fixedly attached to table edge 905 and a sewing head of the sewing machine 111 may be configured to be movable and adjustable relative to such fixed edge guide based on measurement feedback (e.g., from panel length measurement sensors) with regards to dimensions of the material panel.

Material slow-down sensor 903 assists, e.g., in slowing the sewing machine 111 down from a maximum speed to a slower speed as the trailing edge of a panel approaches the sewing machine 111. This allows the sewing machine 111 to stop accurately on an edge of the panel and prevents over-traveling. Preferably, the material slow-down sensor 903 is oriented on the table 103 at least at a distance 'Y' from pivot actuation reflector 811 such that when the slow-down sensor 903 is triggered, the sewing machine 111 has sufficient time to make at least about a 20-25% reduction in its top sewing speed prior to when the edge of the panel reaches the reflector 811. Advantageously, once the panel has attained about a 20-25% reduction in processing speed prior to reaching reflector 811, the panel can be successfully and accurately stopped at the precise desired location (e.g., at reflector 811). An exemplary distance 'Y' may comprise at least about 6 inches. Furthermore, location of the slow-down sensor 903 on table 103 is preferably at least at a distance 'X' from the table edge 905, so as to be out of range of unintentional human interference from an operator. An exemplary distance 'Y' may comprise at least about 24 inches.

In addition, the material slow-down sensor 903 may be used to determine the length and width of the panel, as described below e.g., with reference to FIGS. 11-13.

A panel 1101 loaded onto table 103 includes a leading edge 1103 which is grasped by the gripper assembly 101, a side edge 1102 positioned flush against edge guide 901 which comprises the edge being processed (e.g., cut/sewn), and a trailing edge 1105 which is the next edge of panel 1101 to be processed after processing of the side edge 1102 is completed.

An exemplary system and method for automatically determining panel length according to one aspect of the present principles will now be described. A distance 1113 is measured via the magnetic sensor 725 located on gripper assembly 101, relative to the pivot center 1107. That is, when the gripper assembly 101 is fully forward (e.g., closest to the sewing machine 111) the distance from the gripper 101 to the pivot center 1107 is a fixed and known value (e.g., X inches). As the gripper assembly 101 moves backwards in direction 1117, the additional distance is added to the fixed value X to produce value 1113.

A distance 1115 (e.g., the distance from the material slow-down sensor 1109 to pivot center 1107) also typically comprises a fixed and known (predetermined) value. When the trailing edge 1105 of the panel 1101 triggers the sensor 1109, the system (e.g., via user interface computer 101) adds together the distances 1113 and 1115. Accordingly, a full length of the panel side 1102 is determined.

An exemplary trimming and pivoting system and method according to one aspect of the present principles will now be described. Referencing the desired panel dimensions entered into the user interface, the system permits the operator to sew until the desired length of the panel side has been sewn, and stops at the precise location required to have the side sewn the desired length after the pivot operation. For example, an operator desires the panel to be 80.5" in length. The system (e.g., via the sensor) determines that the length of the panel is 83.25" (length of 1113 plus 1115). Therefore, a 2.75" scrap 1203 (cross-hatched area) will need to be trimmed off on the next panel side 1105.

To accomplish this, the system moves the edge guide 901 2.25" away from the table edge 1205. The gripper assembly 101, grasping the leading edge 1103 of the panel, moves the panel in direction 117 until the trailing edge 1105 reaches the pivot center 1107 (thus activating the pivot actuation sensor as discussed above). The gripper assembly 101 releases the panel and goes into the docked or 'waiting' position (e.g., see FIG. 13) while the pivot assembly pivots the panel (here, about 90 degrees) in direction of arrow 1301. Once the panel is pivoted, the panel edge to be trimmed is positioned flush against an extended edge guide 901. Thus the trim edge 1201 is caused to line up with trim knife 1001 of the sewing machine, which cuts along edge 1201 thereby trimming off cross-hatched area 1203.

Figure 14:
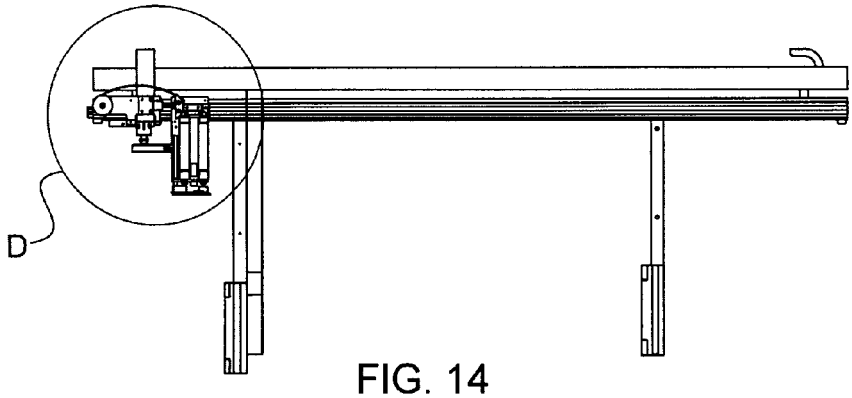
FIG. 14 is a side view of an actuator assembly showing a gripper assembly "D" according to another embodiment of the present invention.
Figure 15A:
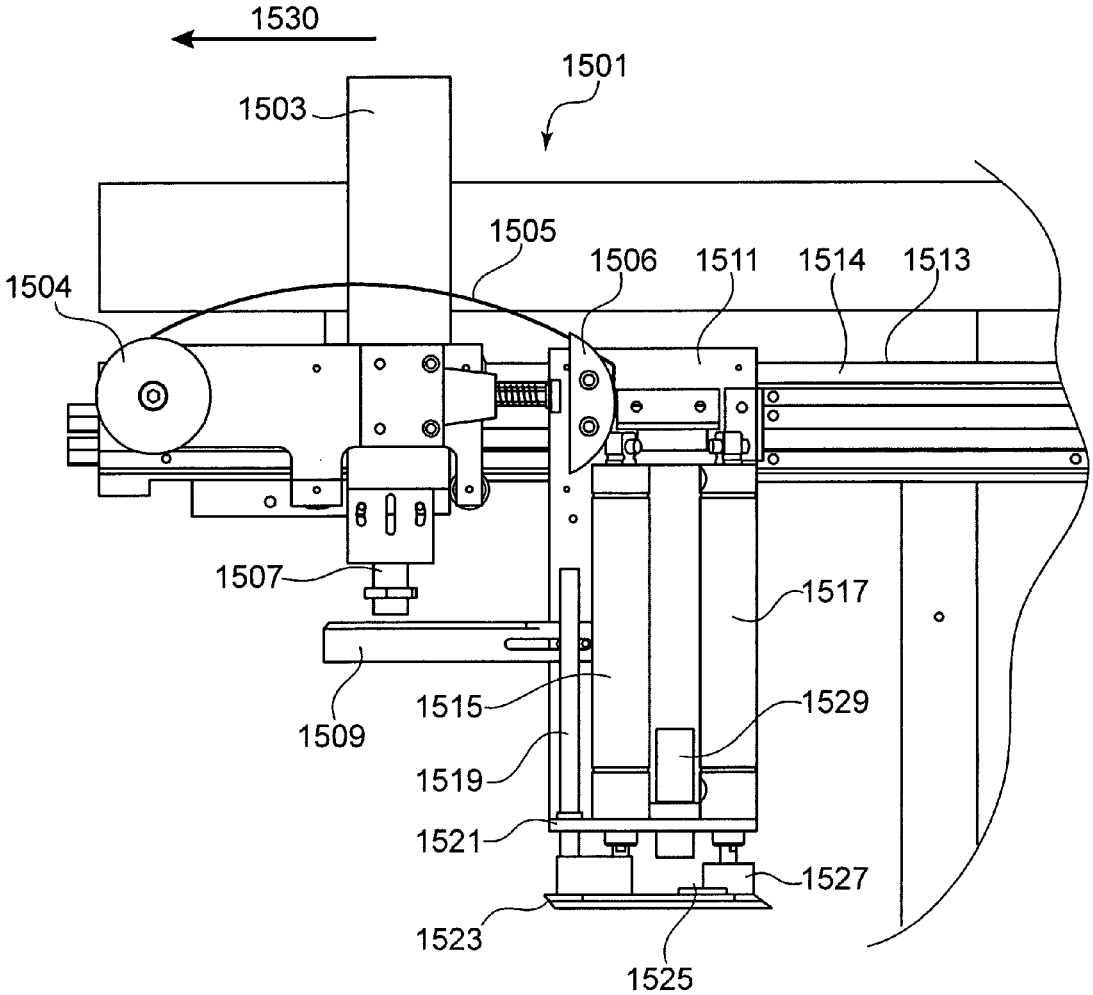
FIG. 15A is an enlarged side view of the gripper assembly of section "D" of FIG. 14.
Figure 15B:
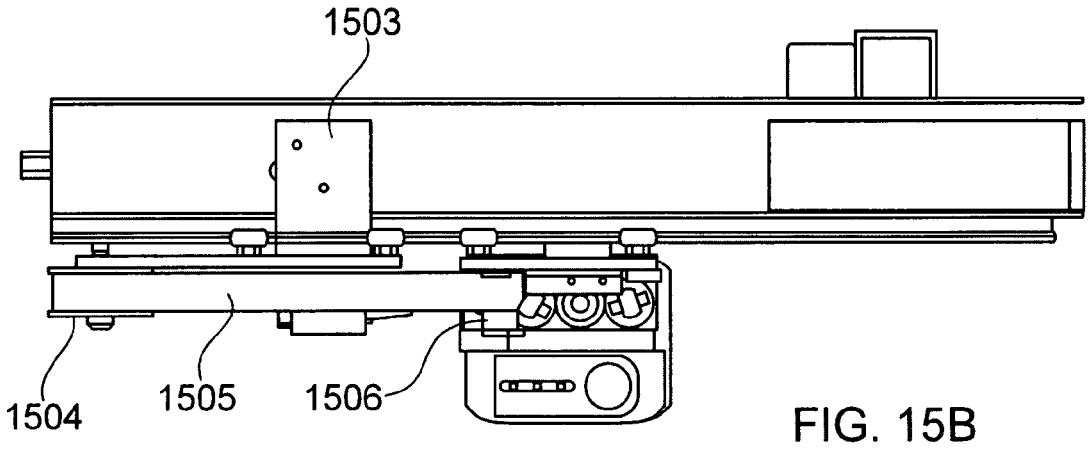
FIG. 15B is a top view of the gripper assembly of FIG. 15A.
Figure 15C:
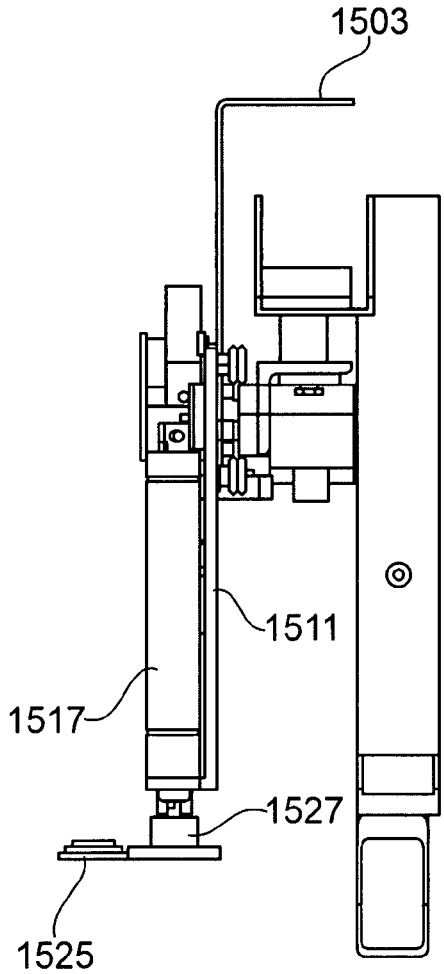
FIG. 15C is a right side view of the gripper assembly of FIG. 15A.

FIG. 14 is a side view of an actuator assembly showing a gripper assembly in area "D" according to another embodiment of the present invention, and FIGS. 15A-C are enlarged front, top and right side views, respectively, of the gripper assembly in area "D" of FIG. 14.

According to an alternate embodiment, a gripper assembly 1501 comprises an actuator carriage 1503 which is preferably motorized and includes a tension control system. In this embodiment, the tension control system is comprised of a tension coil device 1505, tension control sensor 1507 mounted on the actuator carriage 1503 and a sensor activator 1509 mounted onto the carriage plate 1511. The coil device 1505 is comprised of a length of material having tensile force (e.g., a coiled metal material), with a first end secured to base 1506 mounted on the carriage plate 1511 and a second end to reel 1504 mounted on the actuator carriage 1503. Thus, the actuator carriage 1503 with the tension control system is operably connected to the carriage plate 1511 and configured to drive the plate 1511 along the track 1513 in a controlled fashion with minimal tension or stress being exerted on the material (e.g., mattress panel) being held by the carriage plate 1511.

The carriage plate 1511 is slidably attached to the track 1513 and further includes clamp actuator cylinders 1515, 1517, a guide shaft 1519 and a clamp plate 1523 and clamp pad 1527 operably mounted thereon. In one embodiment, the track 1513 may include a sensor strip 1514, configured to work together with at least one sensor (not shown—e.g., may be mounted behind carriage plate 1511) to assist in measuring panel edge lengths, described above, e.g., with reference to FIGS. 11-13. In one embodiment, the sensor may comprise, e.g., at least one magnetic sensor and strip 1514 may comprise a magnetic sensor strip. However, alternate sensor means for assessing distance information may be contemplated, such as rotary encoders, ultrasonic sensor systems, multiple fixed reflective sensors arranged at discrete locations along the track 1513, etc.

A material edge sensor 1529 (e.g., a photocell/photoeye sensor) is provided mounted on an upper plate 1521, and a corresponding sensor reflector 1525 is provided on the clamp plate 1523. During operation according to one embodiment, when an edge of material is detected via the material sensor and reflector 1529, 1525, the actuator carriage 1503 is caused to stop moving and the clamp actuator cylinders 1515, 1517 are deployed, lowering the clamp pad 1527 until it has successfully clamped the material onto the lower clamp plate 1523.

Once the clamp pad and plate 1527, 1523 have engaged the material, the actuator carriage 1503 is energized, such that the carriage 1503 is caused to be moved in a backwards direction 1530 (e.g., away from the sewing machine 111). The carriage 1503 continues to move until the tension between it and the carriage plate 1511 exceeds a force of the tension coil 1505. When this force is exceeded, the actuator carriage 1503 begins to separate from the carriage plate 1511 until the tension control sensor 1507 is activated by the sensor activator 1509. Advantageously, this process ensures that the material to be processed is not caused to be subject to undesirable tension, thus avoiding misshapen or otherwise defective panels with inaccurate dimensions.

Figure 16:
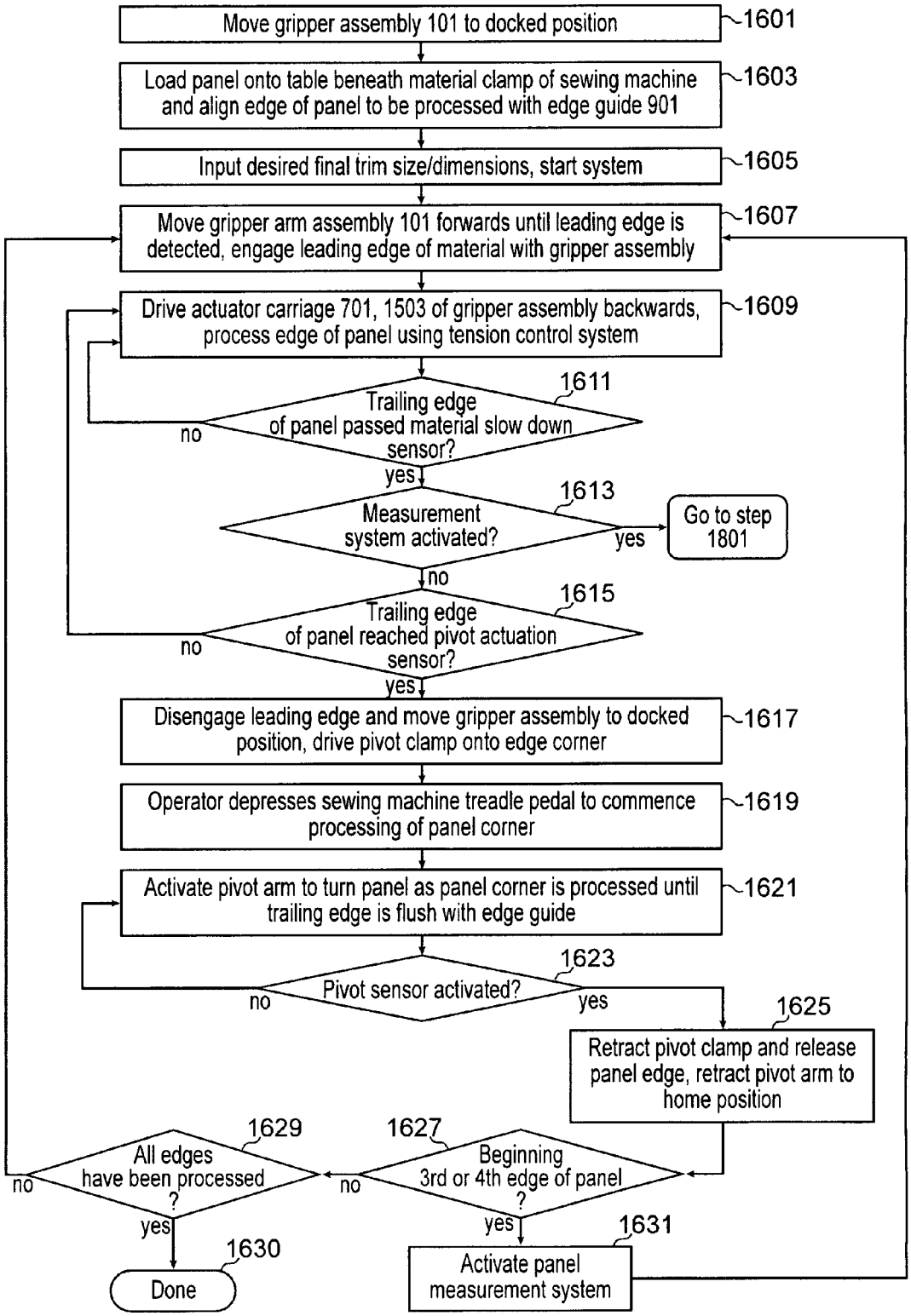
FIG. 16 is a flow chart depicting an exemplary method of processing a material panel according to one aspect of the present invention.

FIG. 16 is a flow chart depicting an exemplary method of processing a material panel according to an aspect of the present invention. Note that components described in the method steps may comprise any of the components described above, and are not limited to a single embodiment of a component. For example, the term "gripper assembly" may include the gripper assembly shown in either FIG. 7 or FIG. 15A.

In step 1601, when a panel is desired to be loaded, a gripper assembly (e.g., 101) in serger flanger system according to the present invention is preferably moved to a docked position (e.g., as shown in FIG. 3). The operator loads a panel (e.g., quilted mattress panel) beneath the presser foot/material clamp of the sewing machine and aligns the edge of the panel to the edge guide (e.g., adjustable edge guide 901).

In step 1605, once the panel is loaded, the operator may select a desired final trim size e.g., either by entering a value or selecting a pre-programmed choice displayed on the touch screen operator interface (king size bed, queen, twin, full, etc.). Once the choice has been made, the operator may press the "START" command on the screen to start the system.

In step 1607, the gripper assembly (actuator carriage 701, 1503 and carriage plate 721, 1511) is moved forwards, towards the sewing machine, from its docked rear position (start-up position). The clamp plate actuator (e.g., 7091 may also be activated, until the lower face of the clamp plate (e.g., 715, 1523) is just above the table top surface (1/16" clearance). The actuator continues moving the carriage assembly until the material sensor (e.g., 719, 1529) detects the leading edge of the panel. Once the edge is detected, the carriage immediately freezes/locks in position. The clamp actuator then engages, lowering the clamp until it has clamped the panel material to the lower clamp plate.

Figure 17:
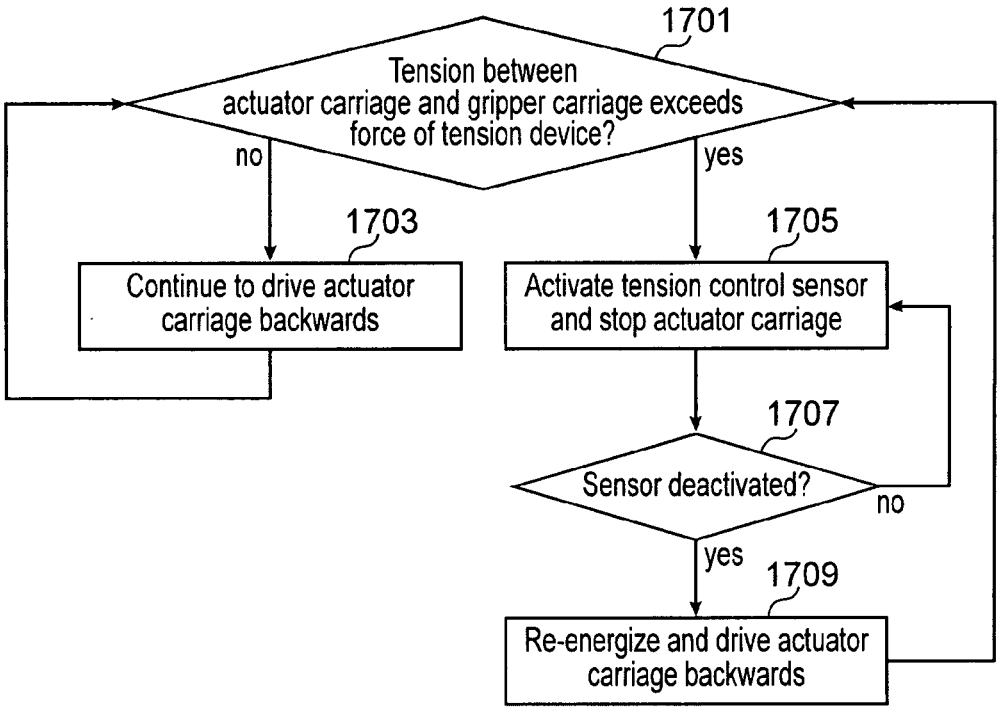
FIG. 17 is a flow chart depicting exemplary method steps of a tension control process according to one aspect of the present invention.

Once the clamp has positively engaged the material, the linear actuator is then energized (step 1609), such that the actuator carriage (e.g., 701, 1503) is driven backwards away from the sewing machine, pulling the panel under the sewing machine which accordingly processes (trims and/or sews) the panel edge, while employing a tension control system. FIG. 17 outlines exemplary method steps of a tension control process according to an aspect of the present invention. Namely, the actuator carriage continues to move backwards (and accordingly pull the panel backwards) until it is determined (step 1701) that the tension between the actuator carriage and the carriage plate (e.g., 721, 1511) exceeds the force of the tension control device (e.g., 703, 1505). When this force is exceeded, the actuator carriage begins to separate from the carriage plate until the tension control sensor is activated by the sensor activator (e.g., a steel plate actuating a magnetic proximity detector sensor), at which point the actuator carriage is stopped (step 1705). If at step 1701 the tension is not exceeded, the process continues to drive the actuator carriage backwards (step 1703) and the process goes back to step 1701.

At step 1707, it is determined if the sensor is deactivated. If no, the process goes back to step 1705. If yes, the actuator carriage is re-energized and moved backwards (step 1709) and the process loops back to step 1701. A tension control system and method according to the present principles is preferably employed at all times during which each panel edge is being handled and processed by a serger flanger system according to the present invention. Advantageously, a tension control system and method according to an aspect of the present principles ensures that the gripper assembly can never apply any excess tension to the product being sewn.

As the operator sews along one straight edge of the panel, the gripper assembly moves backwards with the panel's leading edge in its grasp. In step 1611, it is determined whether a trailing edge of the panel has passed/reached the material slow-down sensor (e.g., 903). If no, the process goes back to step 1609. If yes, it is determined in step 1613 whether a panel dimension measurement system has been activated. If no, in step 1615 it is determined whether the trailing edge has reached the pivot actuation sensor (e.g., 811). If yes, the process proceeds to step 1801, described further below.

If the trailing edge of the panel has reached the pivot actuation sensor, the leading edge of the panel is disengaged, the gripper assembly is moved to the docked position and the pivot clamp (e.g., 807) is caused to engage the panel edge corner (step 1617). That is, movement of the panel is stopped and the clamp actuator cylinder disengages and lifts upwards, releasing the panel from its grasp. When the panel is free, the main linear actuator is energized again, bringing the gripper assembly back to its rear most position (farthest from the sewing machine), free and clear of the panel. At this point, the pivot actuator cylinder (e.g., 803) is energized, driving the pivot clamp down into the top of the panel material below. The pivot clamp position may be preset such that the desired radius (e.g., 2.0", 2.5", 3.0") is guaranteed as the panel is rotated and processed (e.g., trimmed and/or sewn by the sewing machine).

When the pivot clamp is fully depressed, the system waits for the operator to depress the sewing machine treadle pedal. In step 1619 the operator deploys the treadle pedal to commence processing of the panel corner). When the pedal is depressed, the machine begins to sew. Because the pivot clamp is engaged, the panel material is forced to turn radially, centered about the pivot clamp. As the pivot clamp turns with the material, the pivot sensor reflector (e.g., 809) turns with it, moving radially towards the pivot sensor (e.g., 805). As this is occurring, the pivot plate is sweeping the panel in an arc (step 1621), preferably e.g., about 90 degrees, and handles the full weight of the panel, such that the operator is not required to pull the fabric around the table as the panel corner edge is sewn. Again, this allows the operator to concentrate fully on the tailored finish of the corner, as well as relieve the stress of moving the material by hand.

This portion of the cycle continues until the pivot sensor reflector is directly beneath the pivot sensor, thus activating the pivot sensor (step 1623). For example, this position may be preset to correspond to a precise rotation of exactly 90 degrees (though this angular dimension can be adjusted to a slightly larger or slightly smaller dimension as desired), and ensures that the panel is consistently rotated the desired amount at every corner of the panel being processed.

Figure 18:
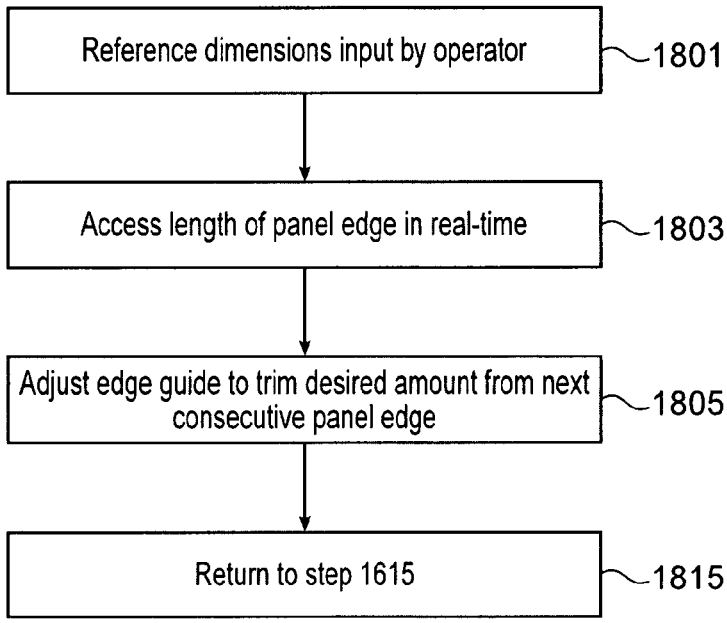
FIG. 18 is a flow chart depicting exemplary method steps of a measurement system according to one aspect of the present invention.

Once the panel has rotated the full desired amount, the pivot actuator cylinder is de-energized, and the pivot clamp is retracted upwards. Also, the pivot plate is caused to be retracted backwards to its home position (step 1625). In step 1627 it is determined whether it is time for a $3^{rd}$ or $4^{th}$ edge of the panel to be processed. This determination may be made with the computer 801, which may keep track of what number edge of a given panel is being processed. If yes, a panel dimension measurement system is activated (step 1631) and the process goes back to step 1607. Steps 1607, 1609, 1611 are repeated, and at step 1613, the process proceeds to step 1801 in which any dimensions input from the operator prior to beginning the sewing cycle are referenced. FIG. 18 is a flow chart depicting exemplary method steps of a panel measurement control system according to an aspect of the present invention, and will now be described.

In step 1803 a length of the panel edge is assessed. This may be done by computer 801, which takes note of the orientation of the gripper assembly and knows the linear location of the gripper assembly via its magnetic sensor (e.g., 725) during steps 1609 and 1611. For example, as the operator continues to sew, the computer continuously and in real-time measures the length of the panel edge being processed, comparing it to the desired dimension(s). When the trailing edge of the panel passes the material slow-down sensor, the panel's absolute length along that edge is known. The computer then automatically determines how much material needs to be trimmed off of the next panel edge, and adjusts the moveable edge guide to accommodate the required trim (step 1805). The process returns to step 1615. Once the next edge is sewn, at least one of the two desired dimensions (e.g., length and width) will be realized, since the panel will be pivoted and the next edge will be moved flush against the edge guide which is in the modified position to accommodate the desired trim (e.g., as shown in FIGS. 11-13). Note that this measuring/trimming operation may occur similarly on the 4th straight side, such that the final dimension (either length or width) will also be realized. For example, panel material may be trimmed off the $3^{rd}$ and $4^{th}$ edges in the order of processing to attain the desired panel length and width. In one embodiment, processing of a panel having four sides/edges may require at least five runs (i.e., at least one edge of the panel will be run through the process twice) to process all four edges and four corners. That is, processing of a first side may be started halfway along its length by default (a work-in-process tag may be sewn in at this midway start point location). When an operator begins processing a panel, the edge guide is preferably in a home position (not extended). When the $4^{th}$ corner of the panel is done, the $1^{st}$ edge is processed until the operator gets up to the point where the process was started. Preferably, the operator sews an additional few inches and overlaps the start point. Once the overlap is completed, the operator may hit the stop command (opening all clamps).

If at step 1627, it is determined that neither a $3^{rd}$ or $4^{th}$ run is about to be commenced (e.g., if a $2^{nd}$ or $5^{th}$ run is being started) it is determined whether all the edges have been properly processed (e.g., whether a panel having 4 edges has been subject to at least 5 runs as described in the above paragraph). If yes, the process is done (step 1630). If no, the process returns to step 1607. Note that during a $5^{th}$ process run, the panel measurement system (e.g., step 1631) does not have to be activated.

Although illustrative embodiments of the present invention have been described herein with reference to the accompanying drawings, it is to be understood that the invention is not limited to those precise embodiments, and that various other alterations, modifications and improvements may be affected therein by one skilled in the art. Such alterations, modifications and improvements are intended to be within the scope and spirit of the present invention. Accordingly, the foregoing description is by way of example only and is not intended to be limiting. This invention should be limited only by the claims and equivalents thereof.

What is claimed is:

1. A system for processing a material panel, the system comprising:

a table supported by a plurality of legs, the table having at least one linear edge;

a sewing machine functionally connected to the table at said at least one linear edge;

an elongate track mounted along said at least one linear edge;

a gripper assembly slidably mounted on the elongate track such that the gripper assembly is capable of gripping a leading edge of the material panel and moving along the track while gripping the leading edge of the material panel;

a tension control system incorporated into the gripper assembly that halts the movement of the gripper assembly along the track when the tension on the leading edge of the material panel exceeds a predetermined force, the tension control system enabling accurate material panel measurements by ensuring that the material panel remains at a low tension level; and at least one sensor movable along said track for measuring at least a length of the material panel.

2. The system of claim 1, further comprising an operator interface operably connected to at least the sewing machine.

3. The system of claim 2, wherein the operator interface is configured for inputting of desired finished length and width data for the material panel.

4. The system of claim 1, wherein the legs comprise adjustable legs configured to be independently adjustable in height.

5. The system of claim 1, further comprising a movable material edge guide mounted adjacent to the sewing machine along said at least one linear edge.

6. The system of claim 1, further comprising a means for moving the sewing machine relative to said at least one linear edge, based on measurement feedback from said at least one sensor.

7. A system for processing a material panel, the system comprising:

a table supported by a plurality of legs, the table having at least one linear edge;

a sewing machine functionally connected to the table at said at least one linear edge;

an elongate track mounted along said at least one linear edge;

a gripper assembly slidably mounted on the elongate track such that the gripper assembly is capable of gripping a leading edge of the material panel and moving along the track while gripping the leading edge of the material panel;

a tension control system incorporated into the gripper assembly that halts the movement of the gripper assembly along the track when the tension on the leading edge of the material panel exceeds a predetermined force, the tension control system enabling accurate material panel measurements by ensuring that the material panel remains at a low tension level; and a plurality of sensors mounted at predetermined locations along the track, for providing measurement feedback of at least one edge of the material panel.

8. The system of claim 7, further comprising an operator interface operably connected to at least the sewing machine.

9. The system of claim 7, further comprising a movable material edge guide mounted adjacent to the sewing machine along said at least one linear edge.

10. A system for processing a material panel, the system comprising:

a table supported by a plurality of legs, the table having at least one linear edge;

a sewing machine functionally connected to the table at said at least one linear edge;

an elongate track mounted along said at least one linear edge;

a gripper assembly slidably mounted on the elongate track such that the gripper assembly is capable of gripping a leading edge of the material panel and moving along the track while gripping the leading edge of the material panel;

a tension control system incorporated into the gripper assembly that halts the movement of the gripper assembly along the track when the tension on the leading edge of the material panel exceeds a predetermined force, the tension control system enabling accurate material panel measurements by ensuring that the material panel remains at a low tension level; and an operator interface operably connected to at least the sewing machine and configured for inputting desired measurement data for the material panel.

11. The system of claim 10, further comprising:

a movable material edge guide assembly, mounted adjacent to the sewing machine along said at least one linear edge.

12. The system of claim 10, wherein the legs comprise adjustable legs configured to be independently adjustable in height.

13. A method for processing a material panel, the method comprising the steps of:

processing at least one edge of the panel using a tension control process, wherein the step of processing further comprises the steps of:

gripping a first end of the panel using a first carriage;

moving the first carriage using a second carriage; and deactivating the second carriage when a tension between the first and second carriages exceeds a predetermined force.

14. The method of claim 13, further comprising the step of connecting the first carriage to the second carriage using a tension device, wherein the predetermined force is determined by a tension device.

15. The method of claim 13, further comprising the step of incorporating human input in real-time during the step of processing.

16. The method of claim 13, wherein the step of processing further comprises:

referencing desired panel dimensions;

assessing a length of at least a first panel edge in real-time during processing of said panel edge; and adjusting a position of an edge guide according to the desired panel dimensions.

17. The method of claim 16, further comprising the steps of:

pivoting the panel to orient a second consecutive edge of the panel flush with the edge guide; and processing the second edge of the panel using the tension control process.

18. The method of claim 17, wherein the step of pivoting further comprises activating a pivot arm to turn the panel until a pivot sensor is activated.

19. The method of claim 17, further comprising the step of assessing if all edges of the material panel have been processed.

* * * * *